US007445316B2

(12) United States Patent
Hirayama

(10) Patent No.: US 7,445,316 B2
(45) Date of Patent: Nov. 4, 2008

(54) PRINTHEAD SUBSTRATE, PRINTHEAD, HEAD CARTRIDGE, AND PRINTING APPARATUS

(75) Inventor: Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 352 days.

(21) Appl. No.: 11/137,581

(22) Filed: May 26, 2005

(65) Prior Publication Data

US 2005/0264608 A1 Dec. 1, 2005

(30) Foreign Application Priority Data

May 27, 2004 (JP) ..... 2004-158029

(51) Int. Cl.
*B41J 2/05* (2006.01)

(52) U.S. Cl. ..... 347/58; 347/57; 347/59

(58) Field of Classification Search ..... 347/9, 347/10, 12, 57, 58, 59, 50, 54, 200
See application file for complete search history.

(56) References Cited

U.S. PATENT DOCUMENTS 5,173,717 A 12/1992 Kishida et al.
5,363,134 A 11/1994 Barbehenn et al.
5,815,390 A * 9/1998 Lakshmikumar ..... 363/73
5,886,713 A * 3/1999 Okada et al. ..... 347/14
6,290,334 B1 9/2001 Ishinaga et al.
6,474,782 B1 11/2002 Furukawa
6,755,580 B2 * 6/2004 Furukawa et al. ..... 400/120.01
2005/0206685 A1 9/2005 Hirayama
2005/0212857 A1 9/2005 Hirayama

FOREIGN PATENT DOCUMENTS

JP 8-118635 5/1996
JP 2001-191531 * 7/2001
JP 2003-58264 2/2003
JP 2004-50639 2/2004

* cited by examiner

*Primary Examiner*—Matthew Luu
*Assistant Examiner*—Henok Legesse
(74) *Attorney, Agent, or Firm*—Fitzpatrick, Cella, Harper & Scinto

(57) ABSTRACT

A driving circuit layout can suppress an increase in the area of a head substrate in an inkjet printhead adopting a constant electric current driving method. A plurality of printing elements and a plurality of switching elements which are very large in number are arrayed in the longitudinal direction of a head substrate. A terminal which receives a driving signal and a control signal that are used to drive the plurality of printing elements is arranged at the end of the board in the widthwise direction of the board. An electric current source for supplying a predetermined electric current is interposed in an area between these two areas.

12 Claims, 20 Drawing Sheets

PRINTHEAD SUBSTRATE, PRINTHEAD, HEAD CARTRIDGE, AND PRINTING APPARATUS

FIELD OF THE INVENTION

This invention relates to a printhead substrate, printhead, head cartridge, and printing apparatus and, more particularly, to a printhead substrate, containing a circuit for driving a printing element by sending a predetermined electric current.

BACKGROUND OF THE INVENTION

An inkjet printhead (to be referred to as a printhead hereinafter), which generates thermal energy by sending an electric current to a heater arranged in the nozzle so as to discharges ink, has conventionally been known.

This printhead is a printhead which employs a method of bubbling ink near the heater by using the generated thermal energy, and discharging ink from the nozzle to print.

In order to print at a high speed, heaters (printing elements) mounted in a printhead are desirably concurrently driven as many as possible to discharge ink at the same timings. However, due to the limited capacity of the power supply of a printing apparatus having the printhead and a voltage drop caused by the resistance of a wiring line extending from the power supply to the heater, a current value which can be supplied at once is limited. For this reason, a time divisional driving method of time-divisionally driving a plurality of heaters to discharge ink is generally adopted. For example, a plurality of heaters are divided into a plurality of groups, and time divisional control is so executed as not to concurrently drive two or more heaters in each group. This can suppress a total electric current flow through heaters and eliminate the need to supply large power at once.

FIG. 17 is a circuit diagram showing an example of the arrangement of a heater driving circuit mounted in a conventional inkjet printhead.

The heater driving circuit shown in FIG. 17 is configured by mounting x heaters in each of m groups so as to concurrently drive one heater in each group, i.e., a total of m heaters, perform this operation x times, and complete driving of one cycle.

As shown in FIG. 17, MOS transistors 1102-11 to **1102-*mx* corresponding to respective heaters 1101-11 to 1101-*mx* are divided into m groups 1100-1 to 1100-*m* which contain the same number of (x) MOS transistors. More specifically, in the group 1100-1, a power supply line from a power supply pad 1103 (power source terminal) is commonly connected to the heaters 1101-11 to 1101-1*x*, and the MOS transistors 1102-11 to 1102-1*x* are series-connected to the corresponding heaters 1101-11 to 1101-1*x* between the power supply pad 1103 and ground (GND) 1104**.

When a control signal is supplied from a control circuit 1105 to the gates of the MOS transistors 1102-11 to **1102-1*x*, the MOS transistors 1102-11 to 1102-1*x* are turned on so that an electric current can flow from the power supply line through corresponding heaters and the heaters 1101-11 to 1101-1*x*** are heated.

FIG. 18 is a timing chart showing a timing at which an electric current is sent to drive heaters in each group of the heater driving circuit shown in FIG. 17. FIG. 18 exemplifies the group 1100-1 in FIG. 17.

In FIG. 18, control signals VG1 to VGx are timing signals for driving the first to x-th heaters 1101-11 to **1101-1*x* belonging to the group 1100-1. More specifically, the control signals VG1 to VGx represent the waveforms of signals input to the control terminals of the MOS transistors 1102-11 to 1102-1*x* of the group 1100-1. A corresponding MOS transistor 1102-1*i* (i=1, x) is turned on for a high-level control signal, and a corresponding MOS transistor is turned off for a low-level control signal. This also applies to the remaining groups 1100-2 to 1100-*m*. In FIG. 18, Ih1 to Ihx represent current values flowing through the heaters 1101-11 to 1101-1*x***.

In this manner, heaters in each group are sequentially and time-divisionally driven by sending an electric current. The number of heaters driven in each group by sending an electric current can always be controlled to one or less, and no large electric current need be supplied to a heater.

FIG. 19 is a view showing the layout of power supply lines connected from the power supply pad 1103 to the groups 1100-1 to **1100-*m* shown in FIG. 17. In other words, FIG. 19 is a view showing part of the layout of a board (head substrate) which forms the heater driving circuit shown in FIG. 17. Particularly, FIG. 19** shows the layout of power supply wiring part in a case where heaters (not shown) are arranged on an upper side of this drawing paper.

As shown in FIG. 19, power supply lines 1301-1 to **1301-*m* are individually connected from the power supply pad 1103 to the respective groups 1100-1 to 1100-*m*, and power supply lines 1302-1 to 1302-*m* are connected to the ground (GND) pad 1104**. In a printhead having m×x heaters (printing elements), time divisional driving of sequentially driving one printing element in each group requires m power supply lines and m ground lines.

As described above, by keeping the maximum number of heaters concurrently driven in each group to one or less, a current value flowing through a wiring line divided for each group can always be suppressed to be equal to or smaller than a current flowing through one heater. Even when a plurality of heaters are concurrently driven, voltage drop amounts on wiring lines on the heater substrate can be made constant. At the same time, even when a plurality of heaters belonging to different groups are concurrently driven, the amounts of energy applied to respective heaters can be made almost constant.

Recently, printing apparatuses require higher speeds and higher precision, and a mounted printhead integrates a larger number of nozzles at a higher density. In heater driving of the printhead, as many heaters as possible are required to be simultaneously driven at a high speed in terms of the printing speed.

A printhead substrate (to be referred to as a head substrate hereinafter) which integrates heaters and their driving circuit is prepared by forming many heaters and their driving circuit on the same semiconductor substrate. In the manufacturing process, the number of heater substrates formed from one semiconductor wafer must be increased to reduce the cost, and downsizing of the head substrate is also demanded.

When, however, the number of concurrently driven heaters is increased, as described above, the head substrate requires wiring lines corresponding to the number of concurrently driven heaters. As the number of wiring lines increases, the wiring region per wiring line decreases to increase the wiring resistance when the area of the head substrate is limited. Further, each wiring width decreases, and variations in resistance between wiring lines on the head substrate increase. This problem occurs also when the head substrate is downsized, and the wiring resistance and variations in resistance increase. Since heaters and power supply lines are series-connected to the power supply on the head substrate, as described above, increases in wiring resistance and variations in resistance lead to an increase in the variation of a voltage applied to each heater.

When energy applied to a heater is too small, ink discharge becomes unstable; when the energy is too large, the heater durability degrades. In other words, in a case where the variation of the voltage applied to heaters is large, the heater durability degrades or ink discharge becomes unstable. For this reason, to print with high quality, energy applied to a heater is desirably constant. Furthermore, it is also desirable to stably apply appropriate energy in view of the durability.

In the above-described time divisional driving where the number of concurrently driven heater is one or less, the voltage drop can be suppressed within the head substrate. However, since a wiring line outside the head substrate is common to a plurality of heaters of plural groups, the amount of voltage drop on the common wiring line changes depending on the number of concurrently driven heaters. In order to make energy applied to each heater constant against variations in the above voltage drop, energy applied to each heater is conventionally adjusted by the voltage application time. However, as the number of concurrently driven heaters increases, a current flowing through a common wiring line generates a large amount of voltage drop. As a result, the voltage applied to a heater decreases. The voltage application time in heater driving must be prolonged to compensate for the voltage drop, and this makes it difficult to drive a heater at a high speed.

As a method which solves such problems caused by variations in energy applied to a heater, for example, Japanese Patent Publication Laid-Open No. 2001-191531 proposes a method of driving a printing element by a constant current.

FIG. 20 is a circuit diagram showing a heater driving circuit disclosed in Japanese Patent Laid-Open No. 2001-191531.

In this arrangement, printing elements (R1 to Rn) are driven by a constant current using constant current sources (Tr14 to Tr(n+13)) and switching elements (Q1 to Qn) which are arranged for the respective printing elements (R1 to Rn).

However, constant current driving disclosed in Japanese Patent Publication Laid-Open No. 2001-191531 requires transistors equal in number to printing elements in addition to switching elements (Q1 to Qn). As a result, the area of the heater substrate becomes much larger than that in a conventional driving method, and the cost of the heater substrate becomes higher.

In order to stabilize energy applied to a heater, output currents from a plurality of constant current sources must be uniform. However, as the number of constant current sources increases, output currents from these constant current sources vary much more. It is difficult to reduce variations in output current between a plurality of constant current sources particularly on a head substrate having a greater number of heaters for higher speed and higher precision of printing in the printing apparatus.

SUMMARY OF THE INVENTION

Accordingly, the present invention is conceived as a response to the above-described disadvantages of the conventional art.

For example, a printhead substrate, a printhead integrating the printhead substrate, a head cartridge integrating the printhead, and a printing apparatus using the printhead according to the present invention are capable of downsizing the size, driving a printing element at a high speed while adopting a constant current driving method of supplying a constant current to each printing element to drive it.

For this downsizing, a driving circuit which solved the above-described technical problems is optimally arranged on the head substrate.

According to one aspect of the present invention, preferably, there is provided a printhead substrate used for driving a plurality of printing elements provided on a board according to a driving method in which a constant electric current flows into the plurality of printing elements through a plurality of switching elements respectively corresponding to the plurality of printing elements, wherein the board has a longer side and shorter side, the plurality of printing elements and the plurality of switching elements are arrayed in a longitudinal direction of the board, a terminal which receives a driving signal and a control signal that are used to drive the plurality of printing elements is arranged near the shorter side of the board, and a constant electric current source for supplying the constant electric current is interposed in an area between a first area where the terminal is arranged and a second area where the plurality of printing elements and the plurality of switching elements are arrayed.

A control circuit which controls ON/OFF operation of the plurality of switching elements on the basis of the driving signal and the control signal is desirably arranged in the longitudinal direction of the board.

Preferably, a supply channel for supplying ink is provided in the longitudinal direction of the board.

It is preferable in the above arrangement that the plurality of printing elements are grouped into a plurality of groups, printing elements belonging to same groups are not concurrently driven, printing elements belonging to different groups are concurrently driven, a plurality of the electric current sources are provided in correspondence to the plurality of groups, and the plurality of the electric current sources are interposed together in the area between the first area and the second area.

Note that the constant electric current sources are composed of an MOS transistor operable in a saturated region.

Preferably, distances between the terminal and the plurality of constant electric current sources corresponding to the plurality of groups are substantially the same.

The printhead substrate may further comprise a reference current circuit which generates a reference current used to generate the constant electric current by the electric current source, a voltage-to-current conversion circuit which generates the reference current on the basis of a reference voltage, and a reference voltage circuit which generates the reference voltage, wherein the reference current circuit, the voltage-to-current conversion circuit, and the reference voltage circuit may be interposed between the first area and the second area.

In addition, a plurality of circuit element groups each obtained by interposing the electric current source between the first area and the second area may be so arranged as to be at least either of vertically symmetrical and horizontally symmetrical on the board.

The plurality of switching elements desirably include MOS transistors.

According to another aspect of the present invention, preferably, there is provided a printhead using a printhead substrate having the above arrangement.

The printhead desirably includes an inkjet printhead which prints by discharging ink.

According to still another aspect of the present invention, preferably, there is provided a head cartridge integrating the above inkjet printhead and an ink tank containing ink to be supplied to the inkjet printhead.

According to still another aspect of the present invention, preferably, there is provided a printing apparatus for discharging ink into a printing medium for printing by using an inkjet printhead or head cartridge having the above arrangement.

The invention is particularly advantageous since a plurality of printing elements and a plurality of switching elements which are very large in number are arrayed in the longitudinal direction of a board, a pad which receives a driving signal and a control signal that are used to drive the plurality of printing elements is arranged at the end of the board in the widthwise direction of the board, and a constant electric current source for supplying a constant electric current is interposed between these two regions. The board area can be effectively utilized, and the wiring length from the signal input pad to the constant electric current source can be shortened on the board. Hence, the present invention can provide a head substrate capable of stable printing at a high speed without increasing the size of the head substrate.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

The following printhead substrate (head substrate) means not only a base of a silicon semiconductor but also a base having elements, wiring lines, and the like.

Furthermore, the term "on a substrate" means not only "on an element substrate", but also "the surface of an element substrate" or "inside an element substrate near the surface". The term "built-in" in the present invention does not represent that each separate element is arranged as a separate member on a substrate surface, but represents that each element is integrally formed and manufactured on an element substrate by a semiconductor circuit manufacturing process or the like.

The term "constant electric current" and "constant electric current source" means a predetermined constant electric current to be supplied to a printing element regardless of a variation on a number of concurrently driven printing element(s) or the like, and an electric current source which supplies the electric current. The value itself of the electric current which is expected to be constant also includes a case where it is variably set to a predetermined electric current value.

<Brief Description of Apparatus Main Unit (FIG. 1)>

Figure 1:
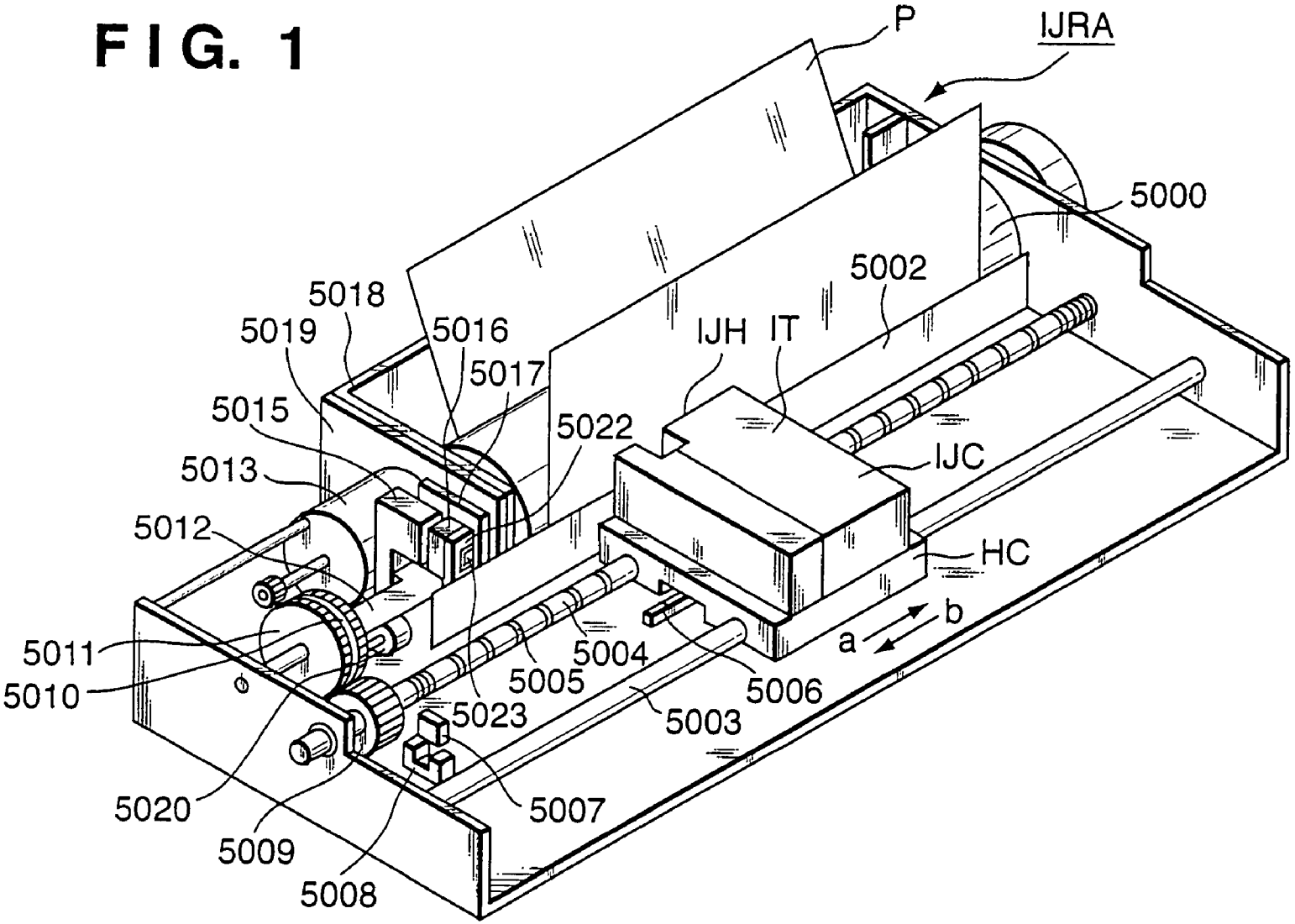
FIG. 1 is an outer perspective view showing a schematic arrangement around the carriage of an inkjet printing apparatus as a typical embodiment of the present invention.

FIG. 1 is a perspective view showing the outer appearance of an inkjet printing apparatus as a typical embodiment of the present invention. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b in FIG. 1. An inkjet cartridge IJC which incorporates an inkjet printhead IJH (hereinafter referred to as "printhead") and an ink tank IT for containing ink is mounted on the carriage HC.

The inkjet cartridge IJC integrally includes the printhead IJH and the ink tank IT.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5012 denotes a lever for initiating a suction operation in the suction recovery operation. The lever 5012 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Figure 2:
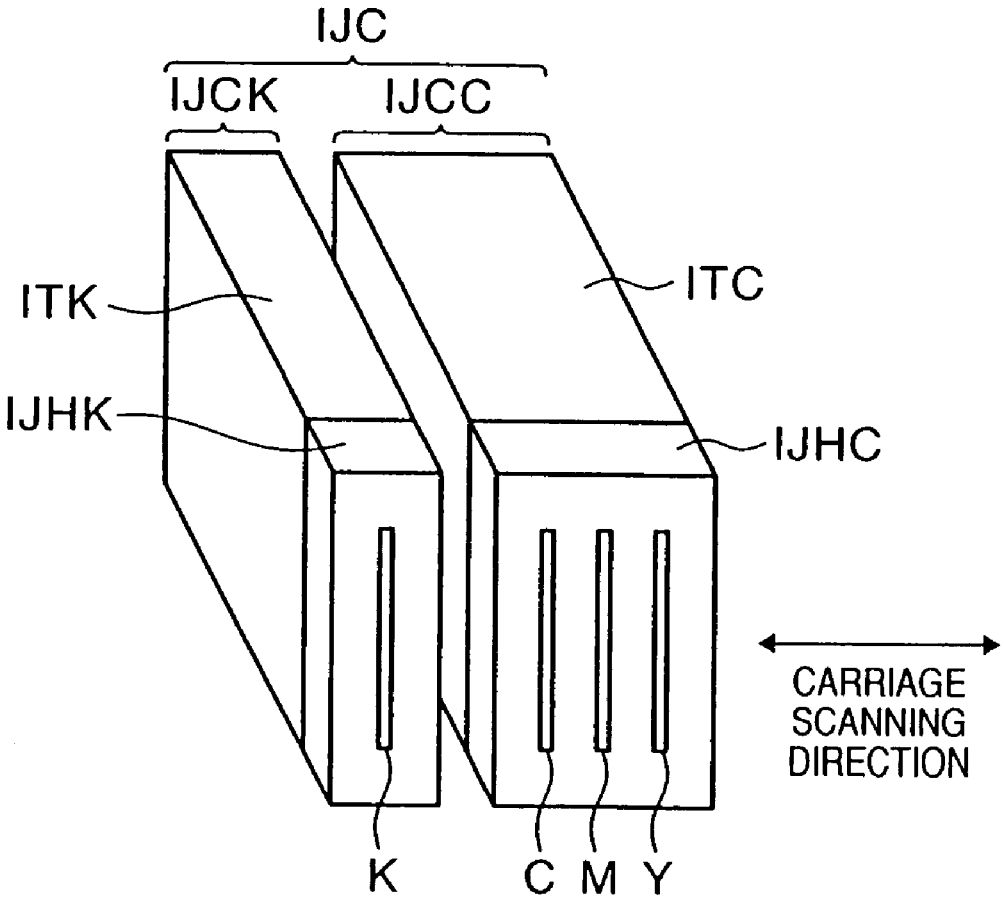
FIG. 2 is an outer perspective view showing the detailed arrangement of an inkjet cartridge IJC.

FIG. 2 is a perspective view showing a detailed outer appearance of the configuration of an inkjet cartridge IJC.

As shown in FIG. 2, the inkjet cartridge IJC is comprised of a cartridge IJCK that discharges black ink and a cartridge IJCC that discharges three colors of ink, cyan (C), magenta (M) and yellow (Y). These two cartridges are mutually separable, with each being independently detachably mounted on the carriage HC.

The cartridge IJCK is comprised of an ink tank ITK that contains black ink and a printhead IJHK that prints by discharging black ink, combined in an integrated structure. Similarly, the cartridge IJCC is comprised of an ink tank ITC that contains ink of three colors, cyan (C), magenta (M) and yellow (Y), and a printhead IJHC that prints by discharging ink of these colors, combined in an integrated structure. Note that it is assumed that the cartridge in this embodiment is a cartridge in which ink is filled in the ink tank.

The cartridges IJCK and IJCC are not limited to the integrated-type, and the ink tank and printhead may be separable.

The printhead IJH is used to generally refer to the printheads IJHK and IJHC together.

Further, as can be appreciated from FIG. 2, an array of nozzles that discharges black ink, an array of nozzles that discharges cyan ink, an array of nozzles that discharges magenta ink and an array of nozzles that discharges yellow ink are aligned in a direction of movement of the carriage, the arrayed direction of the nozzles being disposed diagonal to the carriage movement direction.

Figure 3:
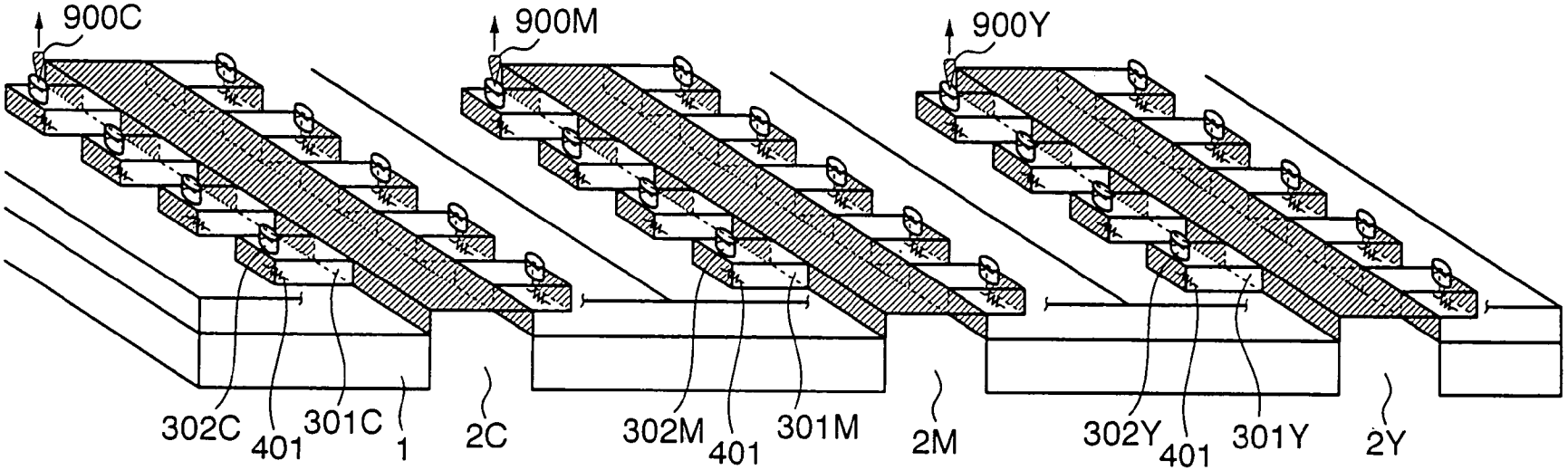
FIG. 3 is a perspective view showing the three-dimensional structure of a printhead IJHC which discharges color inks of three colors.

FIG. 3 is a perspective view showing a three-dimensional structure of a printhead IJHC that discharges three colors of ink.

FIG. 3 shows the flow of ink supplied from the ink tank ITK. The printhead IJHC has an ink channel 2C that supplies cyan (C) ink, an ink channel 2M that supplies magenta (M) ink, and an ink channel 2Y that supplies yellow (Y) ink, and is provided with supply paths (not shown), that supply each of the inks via a rear surface of the substrate from the ink tank ITK to each of the ink channels.

The ink flow paths 301C, 301M, and 301Y are provided in correspondence to electrothermal transducers (heaters) 401. The cyan, magenta and yellow inks that pass through the ink channels ink flow paths 301C, 301M and 301Y, respectively, are each led to electrothermal transducers (that is, heaters) 401 provided on the substrate. Then, when the electrothermal transducers (heaters) 401 are activated via circuits to be described later, the ink on the electrothermal transducers (heaters) 401 is heated, the ink boils, and, as a result, ink droplets 900C, 900M and 900Y are discharged from the orifices 302C, 302M and 302Y by the bubble that arises.

It should be noted that, in FIG. 3, reference numeral 1 denotes a printhead substrate (hereinafter referred to as "head substrate") on which are formed electrothermal transducers and the variety of circuits that drive the electrothermal transducers to be described later, a memory, a variety of pads that form the electrical contacts with the carriage HC, and a variety of signal wires.

Moreover, one electrothermal transducer (heater), and the MOS-FET that drives it are together called a printing element, with a plurality of printing elements called a printing element portion.

Note that although FIG. 3 is a diagram showing a three-dimensional structure of a printhead IJHC that discharges three colors of ink, the structure is the same as that of the printhead IJHK that discharges black ink but comprising one third of the configuration shown in FIG. 3. In other words, there is one ink channel, and the scale of the head substrate is approximately one third that of the structure shown in FIG. 3 if the number of arranged printing elements are the same.

Next, a description is given of the control configuration for executing print control of the printing apparatus described above.

Figure 4:
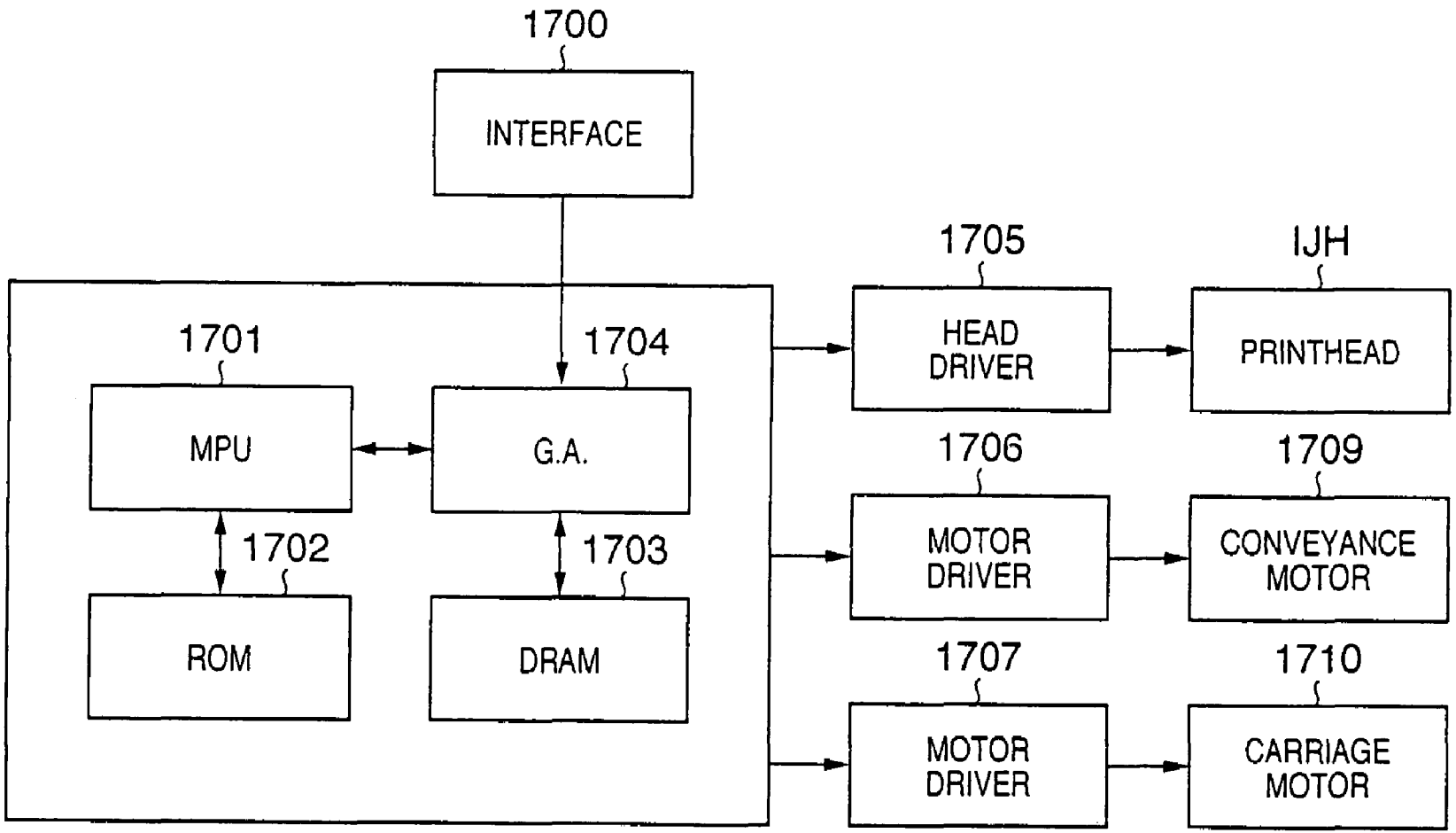
FIG. 4 is a block diagram showing the control arrangement of the printing apparatus shown in FIG. 1.

FIG. 4 is a block diagram showing the arrangement of a control circuit of the printing apparatus.

Referring to FIG. 4 showing the control circuit, reference numeral 1700 denotes an interface for inputting a printing signal; 1701, an MPU; 1702, a ROM for storing a control program executed by the MPU 1701; and 1703, a DRAM for storing various data (the printing signal, printing data supplied to the printhead, and the like). Reference numeral 1704 denotes a gate array (G.A.) for performing supply control of printing data to the printhead IJH. The gate array 1704 also performs data transfer control among the interface 1700, the MPU 1701, and the RAM 1703.

Reference numeral 1709 denotes a conveyance motor (not shown in FIG. 1) for conveying a printing sheet P. Reference numeral 1706 denotes a motor driver for driving the conveyance motor 1709, and reference numeral 1707 denotes a motor driver for driving the carriage motor 5013.

The operation of the above control arrangement will be described next. When a printing signal is input to the interface 1700, the printing signal is converted into printing data for a printing operation between the gate array 1704 and the MPU 1701. The motor drivers 1706 and 1707 are driven, and the printhead IJH is driven in accordance with the printing data supplied to the carriage HC, thus printing an image on the printing paper P.

The embodiment uses printheads having the affangement as shown in FIG. 2, and they are controlled so that printing by the printhead IJHK and printing by the printhead IJHC do not overlap each other in each scanning of the carriage. In color printing, the printheads IJHK and IJHC are alternately driven in each scan. For example, when the carriage reciprocally scans, the printheads IJHK and IJHC are so controlled as to drive the printhead IJHK in forward scan and the printhead IJHC in backward scan. Driving control of the printheads is not limited to this, and printing operation may be done in only forward scan and the printheads IJHK and IJHC may be driven in two forward scan operations without conveying the printing sheet P.

The arrangement and operation of the head substrate integrated in the printhead IJH will be explained.

Figure 5:
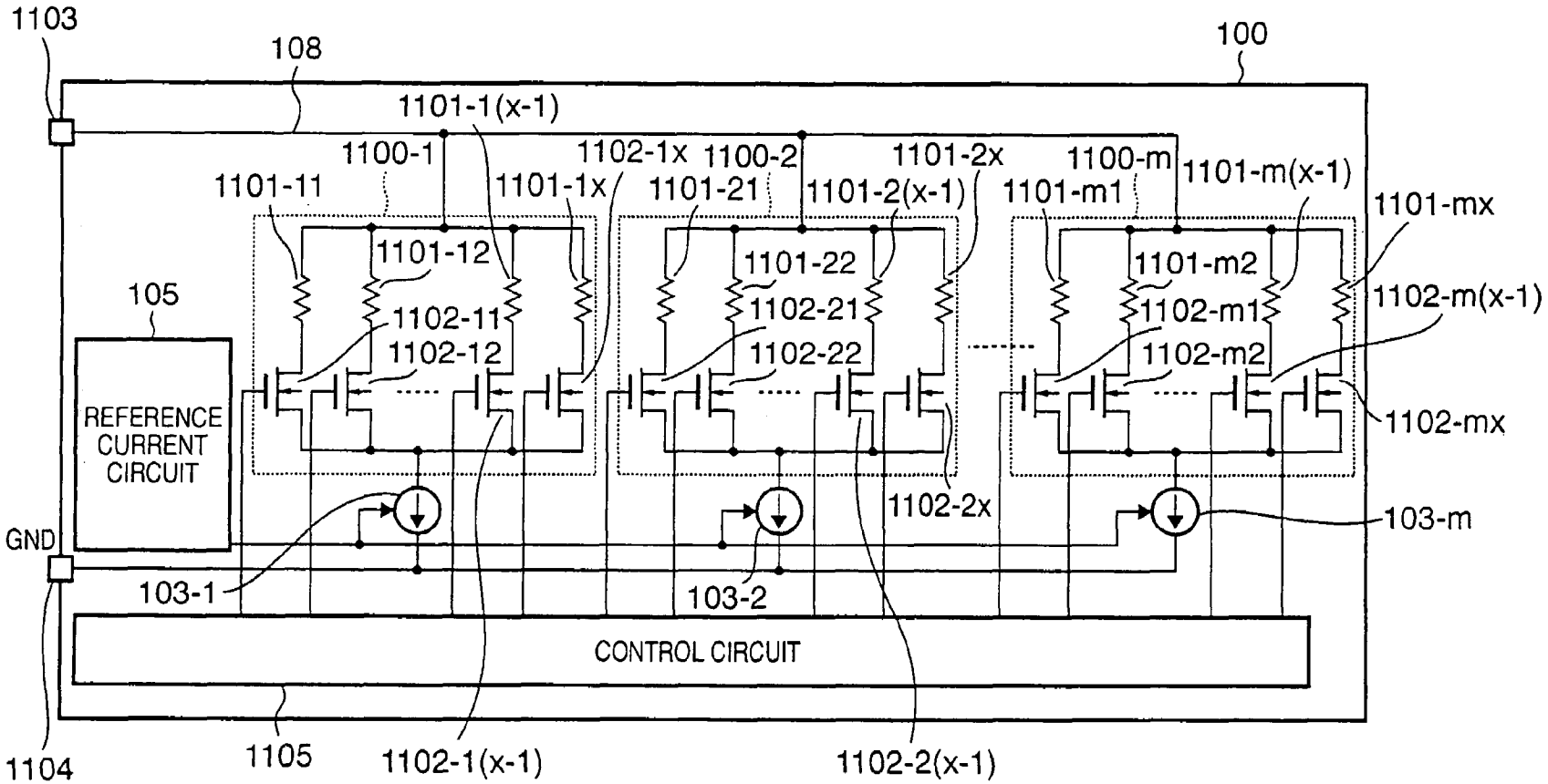
FIG. 5 is a circuit diagram showing an example of the arrangement of a head substrate, which forms a heater driving circuit, mounted on a printhead IJH.

FIG. 5 is a circuit diagram showing an example of the arrangement of a head substrate which forms a heater driving circuit built in the printhead IJH.

Figure 17:
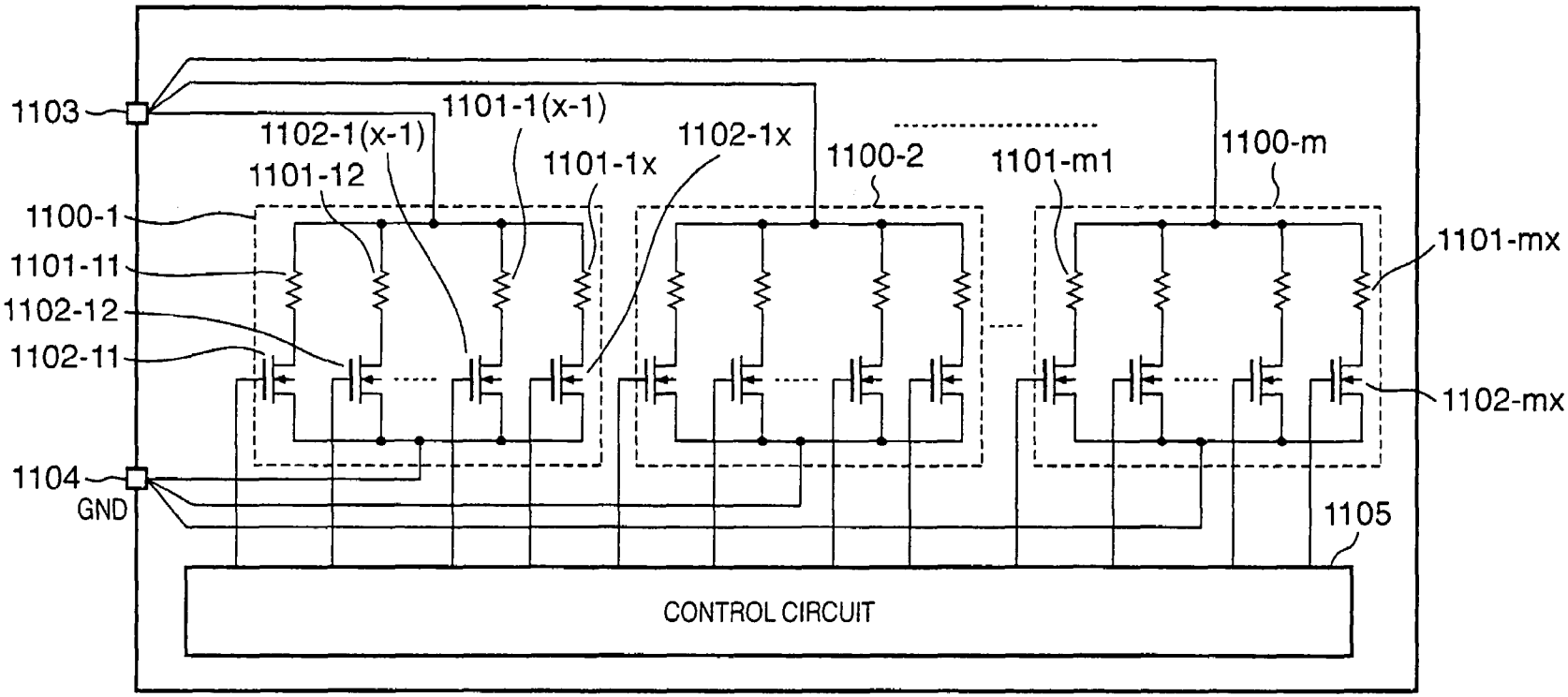
FIG. 17 is a circuit diagram showing an example of the arrangement of a heater driving circuit mounted in a conventional inkjet printhead.
Figure 18:
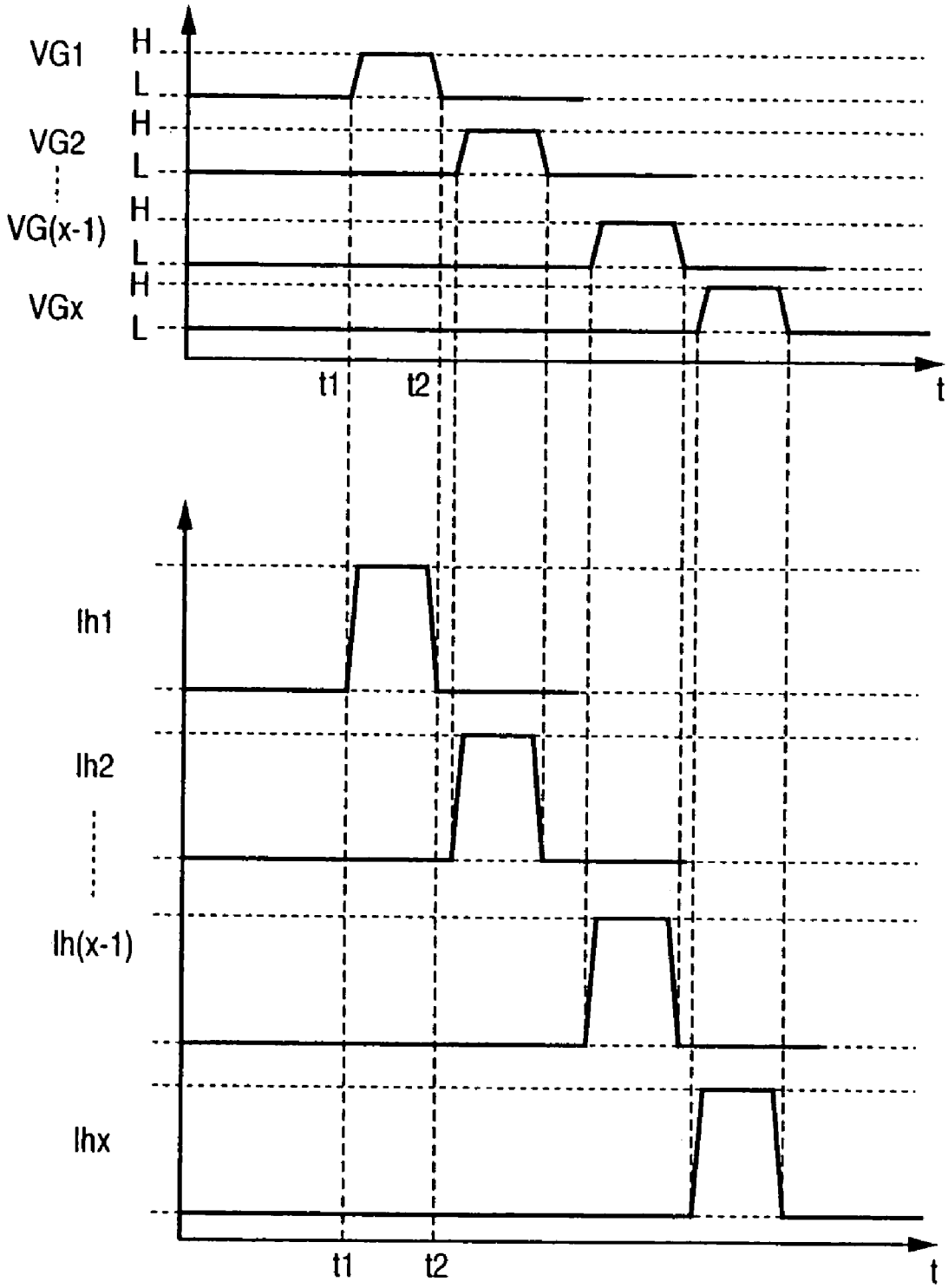
FIG. 18 is a timing chart showing a timing at which an electric current is sent to drive heaters in each group of the heater driving circuit shown in FIG. 17.
Figure 19:
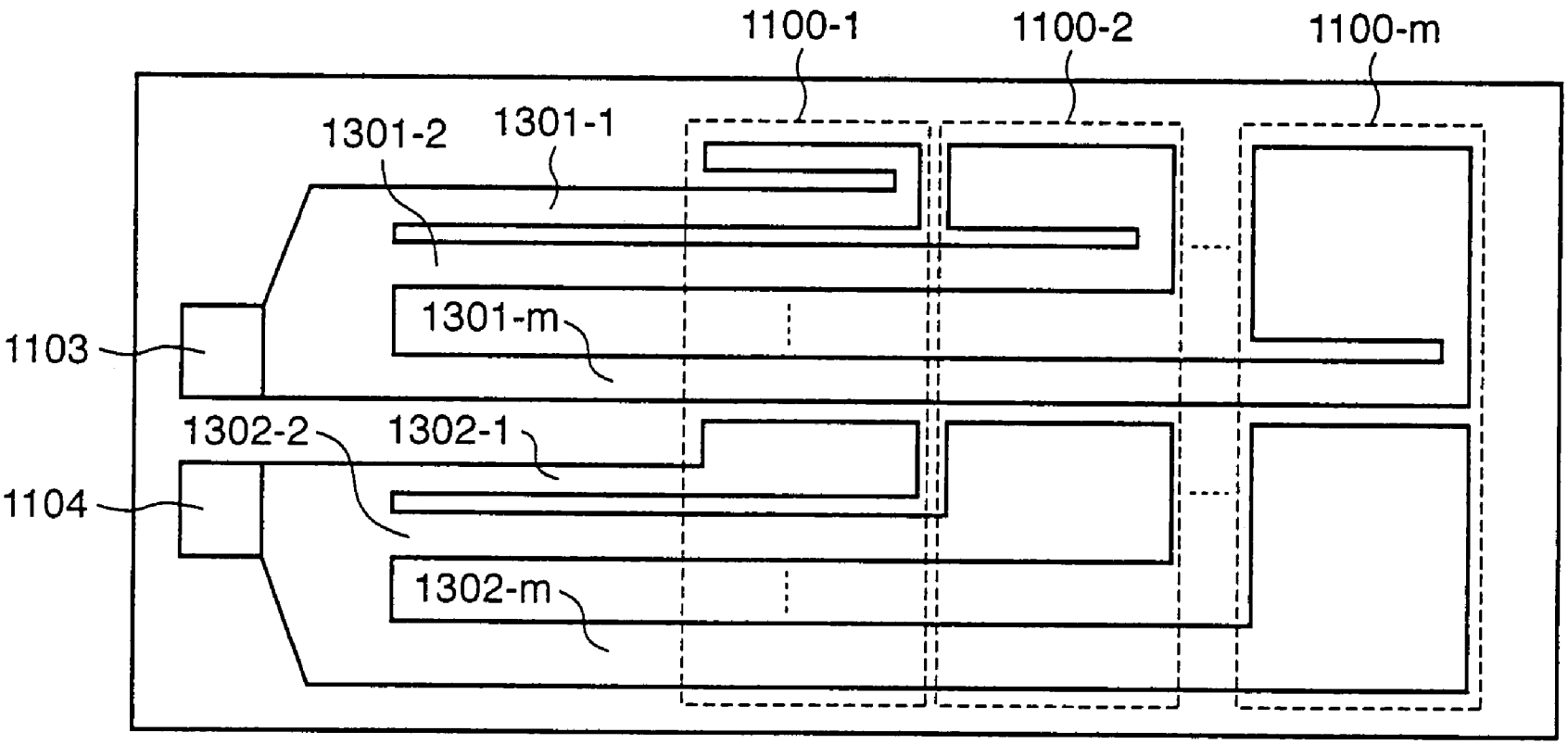
FIG. 19 is a view showing the layout of power supply lines connected from a power supply pad 1103 to groups 1100-1 to **1100-*m* shown in FIG. 17.
Figure 20:
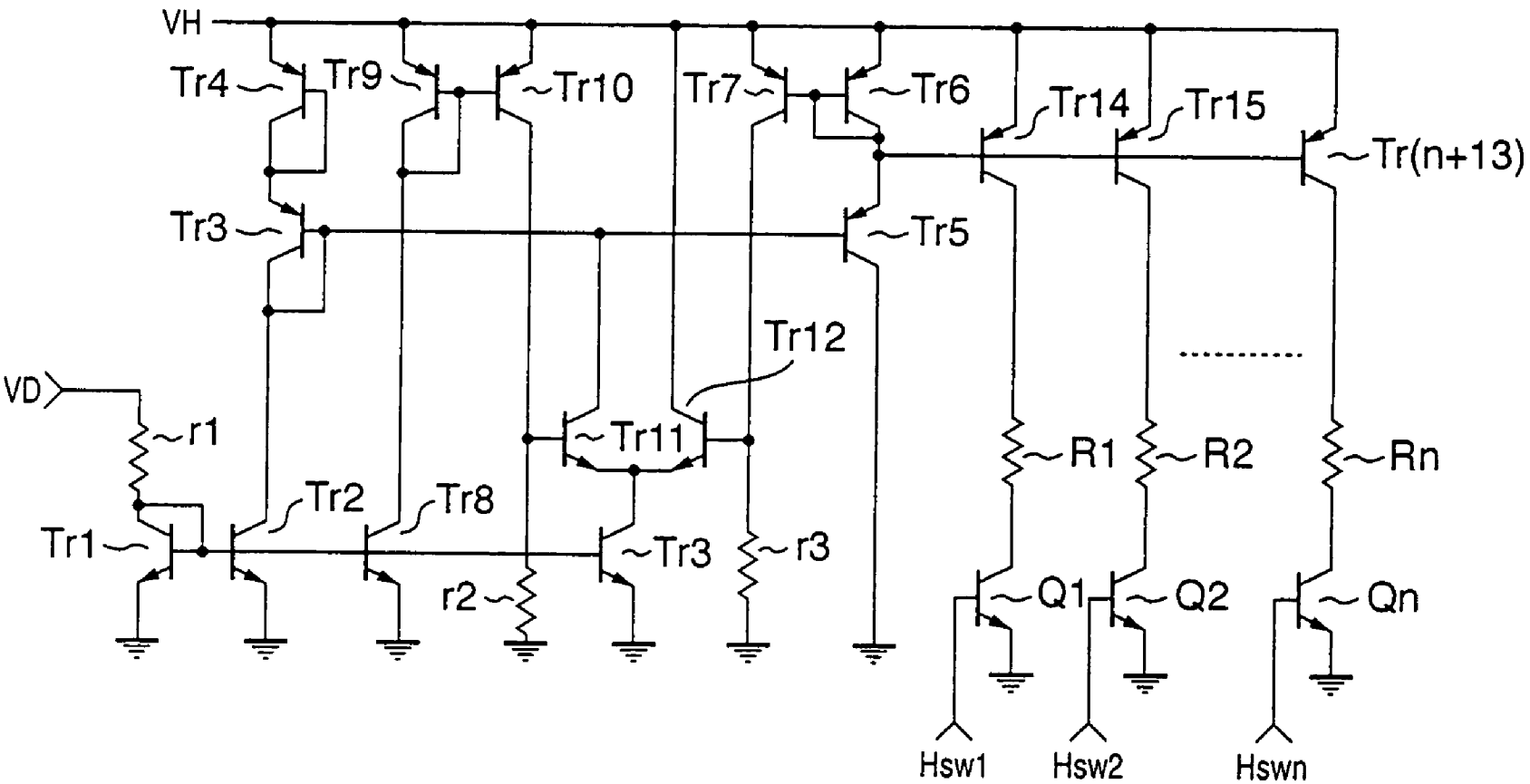
FIG. 20** is a circuit diagram showing a heater driving circuit according to the conventional art.

In FIG. 5, the same reference numerals as those of the conventional case in FIG. 17 denote the same building components, and a description thereof will be omitted. Similar to the conventional case, the arrangement exemplified in FIG. 5 employs a time divisional driving method in which (m×x) heaters and (m×x) switching elements (MOS transistors) are divided into m groups each having x heaters and x switching elements, and one heater is concurrently selected and driven in each group.

In FIG. 5, reference numerals 103-1 to **103-*m* denote constant electric current sources; and 105**, a reference current circuit.

In the heater driving circuit, as shown in FIG. 5, the constant electric current sources 103-1 to **103-*m*** for supplying an electric current to heaters are connected to the respective groups.

For example, in a group 1100-1, the source terminals of MOS transistors 1102-11 to **1102-1*x* respectively series-connected to heaters 1101-11 to 1101-1*x* are commonly connected, the terminals of the heaters on one end in the group are also commonly connected, and the constant electric current source 103-1 is connected to the group. A power supply line 108 is connected to the common connection terminal of the heaters 1101-11 to 1101-1*x***.

The MOS transistors 1102-11 to **1102-1*x* serving as the driving switches for the heaters 1101-11 to 1101-1*x* are series-connected between the power supply line 108 and ground (GND). The high-voltage tolerant MOS transistor 103-1 serving as one of constant electric current sources for sending a predetermined electric current to the heaters 1101-11 to 1101-1*x* is series-connected as a common switch between the MOS transistors 1102-11 to 1102-1*x* and ground (GND). Note that, in this embodiment, the MOS transistors (constant electric current source) 103** are operable in a saturated region to send a predetermined electric current.

The remaining groups 1100-2 to **1100-*m* also have the same arrangement as that of the group 1100-1**.

When the heater driving circuit is viewed as a whole, the heaters 1101-11 to **1101-*mx*, the MOS transistors 1102-11 to 1102-*mx* which function as switches, the constant electric current sources 103-1 to 103-*m* and ground wirings in order from the power supply wiring side are series-connected. The respective constant electric current sources 103-1 to 103-*m* output constant electric currents to the common connection terminals of corresponding groups. The magnitude of the output current value is adjusted by a control signal from the reference current circuit 105**.

The operation of the heater driving circuit having the above arrangement will be described.

This operation is common to the m groups, and one group formed from x heaters will be exemplified.

Figure 6:
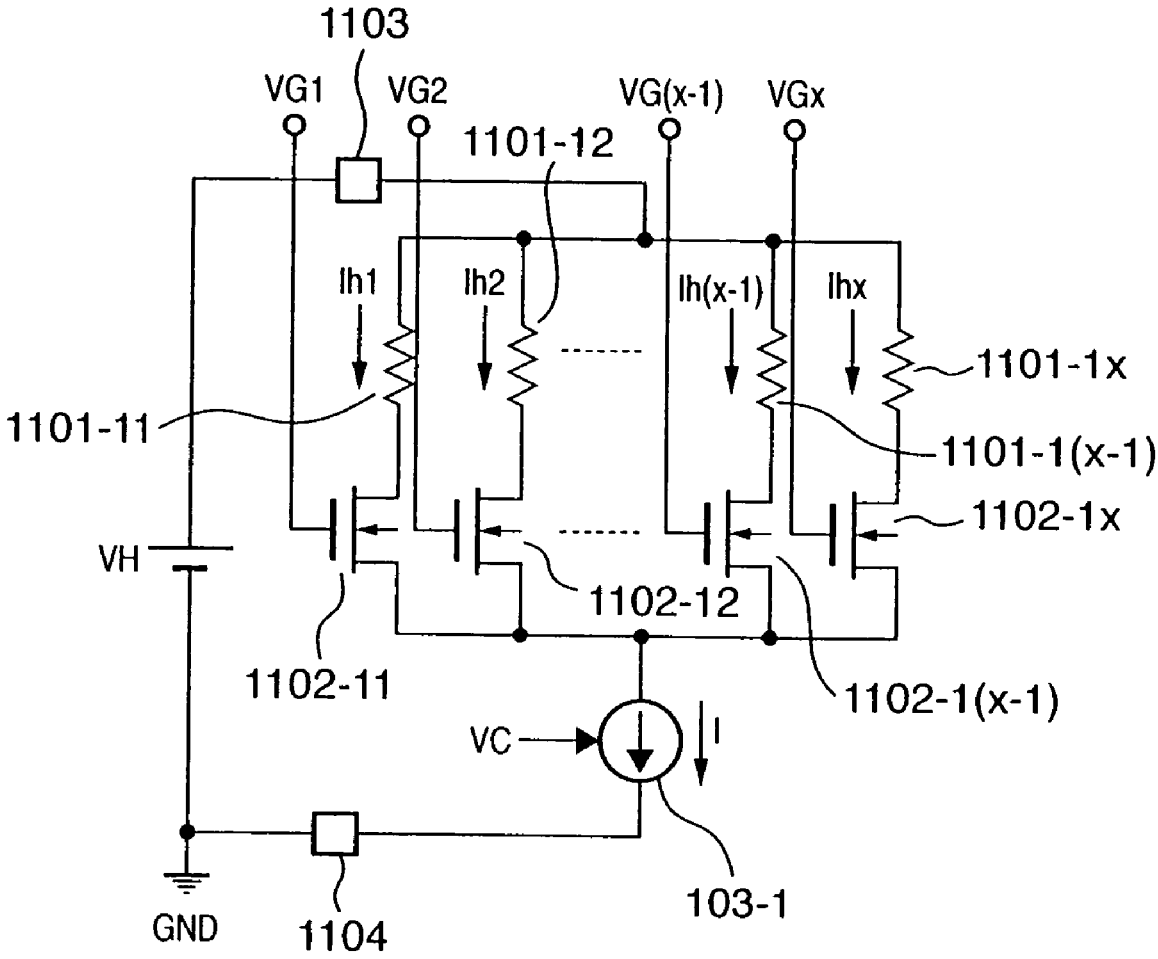
FIG. 6 is a circuit diagram showing the arrangement of one group of the heater driving circuit shown in FIG. 5.

FIG. 6 is a circuit diagram showing the arrangement of one group extracted from the heater driving circuit shown in FIG. 5.

In FIG. 6, the same reference numerals as those in FIG. 17 of the conventional case and FIG. 5 denote the same building components, and a description thereof will be omitted.

In FIG. 6, VG1, VG2, . . . , VG(x-1), and VGx represent control signals which are output from a control circuit 1105 and applied to the gates of the MOS transistors for switching 1102-11, 1102-12, . . . 1102-1(x-1), and **1102-1*x*. Ih1, Ih2, . . . , Ih(x-1), and Ihx represent electric currents flowing through the heaters 1101-11, 1101-12, . . . , 1101-1(x-1), and 1101**-l*x*. VC represents a control signal from the reference current circuit 105.

For descriptive convenience, the MOS transistors for switching 1102-11 to **1102-1*x* are assumed to ideally operate as 2-terminal switches each having the drain and source. The switch is turned on (drain and source are short-circuited) for the VGi (i=1,x) signal level="H", and off (drain and source are open-circuited) for "L". The constant electric current source 103-1 is assumed to output a constant electric current set by the control signal VC between the terminals (in FIG. 6** from top to down) when a given voltage is applied between them.

Figure 7:
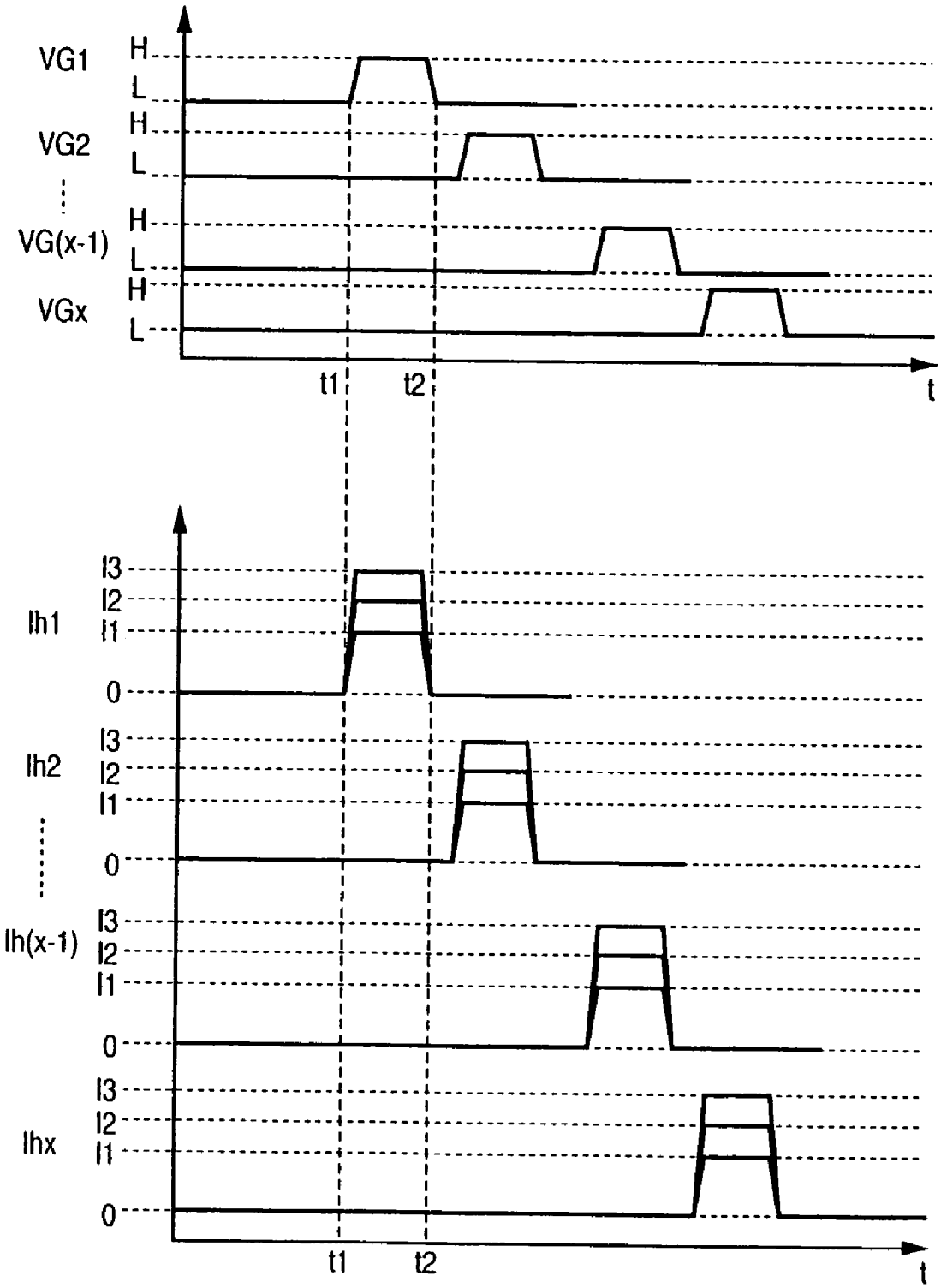
FIG. 7 is a timing chart showing the waveforms of a control signal (VGi) and an electric current (Ihi) flowing through a heater in accordance with the control signal.

FIG. 7 is a timing chart showing the waveforms of the control signal (VGi) and the electric current (Ihi) flowing through a heater in accordance with the control signal.

For example, the control signal VG1 is at "L" during the period up to time t1, the output of the constant electric current source 103-1 and the heater 1101-11 are disconnected, and no electric current flows through the heater. During the period from time t1 to time t2, the control signal VG1 changes to "H", the source and drain of the MOS transistor 1102-11 serving as a constant electric current source are short-circuited, and an electric current output from the constant electric current source 103-1 flows through the heater. After time t2, the control signal VG1 changes to "L" again, and no electric current flows through the heater.

This also applies to the control signals VG2, . . . , and VGx.

The supply time of an electric current to a heater is controlled by the control signal VGi, and the magnitude of the electric current Ihi supplied to the heater is controlled by the control signal VC to the constant electric current source 103-1.

When the electric current flows through the heater 1101-11 during the period from time t1 to time t2, ink on the upper surface of the heater is heated, bubbles, and as a result, is discharged from a corresponding nozzle to print an ink dot.

Similarly, the electric current sequentially flows through the heaters 1101-11 to **1101-1*x* in accordance with signals represented by the timing chart of FIG. 7. Ink dots are printed by discharging heated ink, and then supply of an electric current to the heaters 1101-11 to 1101-1*x*** stops.

With the above arrangement, the reference current circuit 105 sets the output current value of the constant electric current source 103-1, and the set output current flows from the MOS transistors 1102-11 to **1102-1*x* to the heaters 1101-11 to 1101-1*x*** for a desired time.

In actual operation, there are resistances between the sources and drains when the MOS transistors 1102-11 to

1102-1*x* are ON. By setting a power supply voltage high enough against a voltage drop caused by the resistances, an electric current output from the constant electric current source substantially flows through the heater, and substantially the same operation as that in the absence of any ON resistance can be implemented.

The circuit layout of the head substrate having the heater driving circuit, which adopts the above circuit arrangement and performs the above operation, according to the present invention will be described below.

First Embodiment

Figure 8:
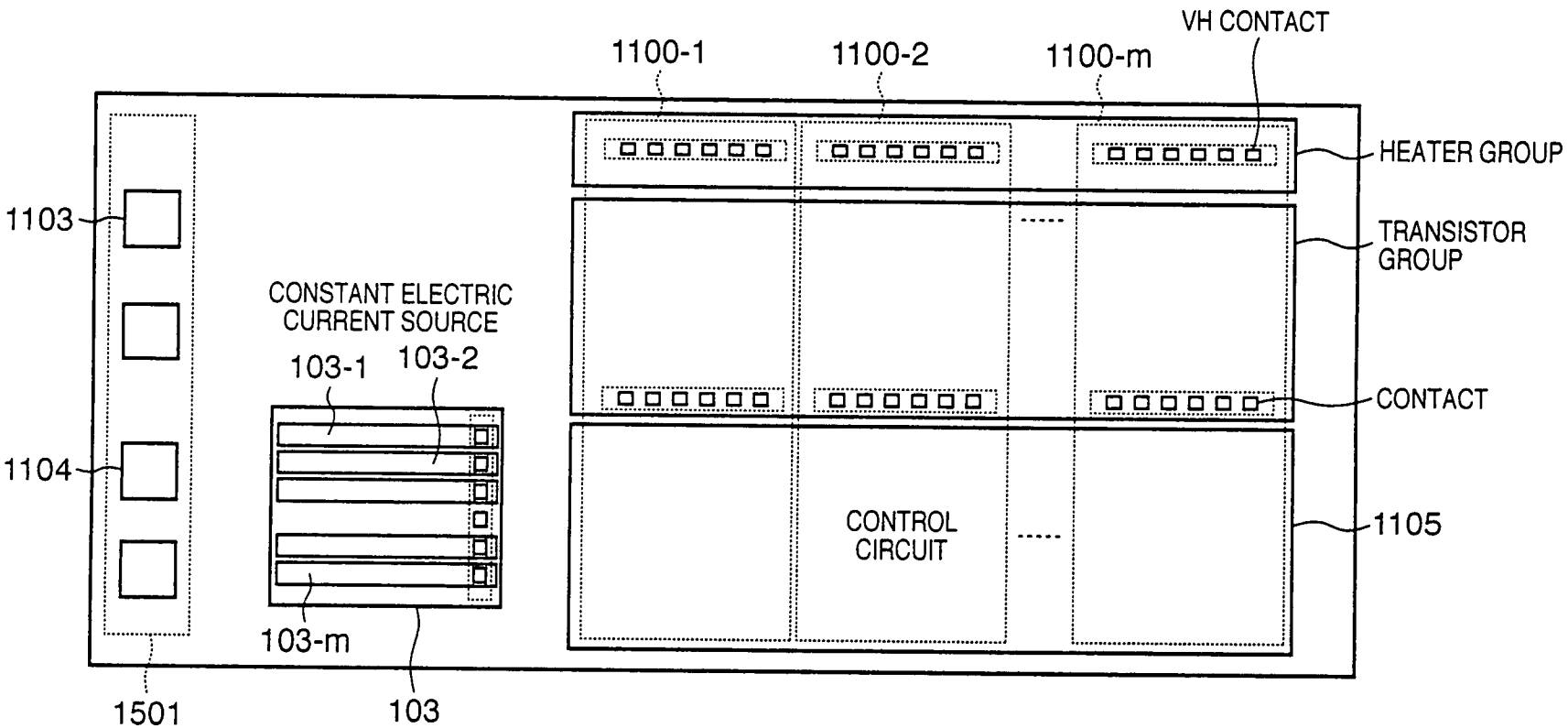
FIG. 8 is a view showing the layout of a head substrate according to a first embodiment of the present invention.

FIG. 8 is a view showing the layout of a head substrate according to the first embodiment of the present invention.

FIG. 8 is an example of a layout for illustrating an actual arrangement of elements, such as the heaters, transistors, control circuits, and constant electric current sources, in the heater driving circuit (equivalent circuit) shown in FIG. 5. Also in FIG. 8, the same reference numerals as those in FIG. 5 denote areas where the corresponding building components are arranged. Note that the head substrate according to the present invention is a rectangular substrate with longer sides and shorter sides. Heaters and transistors for switching are arrayed along with the longer side direction (longitudinal direction).

For example, in a group 1100-1, a heater group and transistor group respectively including heaters 1101-11 to 1101-1*x* and MOS transistors 1102-11 to 1102-1*x* are formed. In a group 1100-2, a heater group and transistor group respectively including heaters 1101-21 to 1101-2*x* and MOS transistors 1102-21 to 1102-2*x* are formed. Similarly, in a group 1100-*m*, a heater group and transistor group respectively including heaters 1101-*m*1 to 1101-*mx* and MOS transistors 1102-*m*1 to 1102-*mx* are formed. In correspondence with m groups, a constant electric current source group 103 is formed from m constant electric current sources 103-1 to 103-*m* which supply electric currents to the respective groups.

An input/output pad group 1501 which provides various contacts (e.g., VH contacts) and electrical contacts with the carriage is formed along with the shorter side direction (widthwise direction) of the head substrate.

Figure 9:
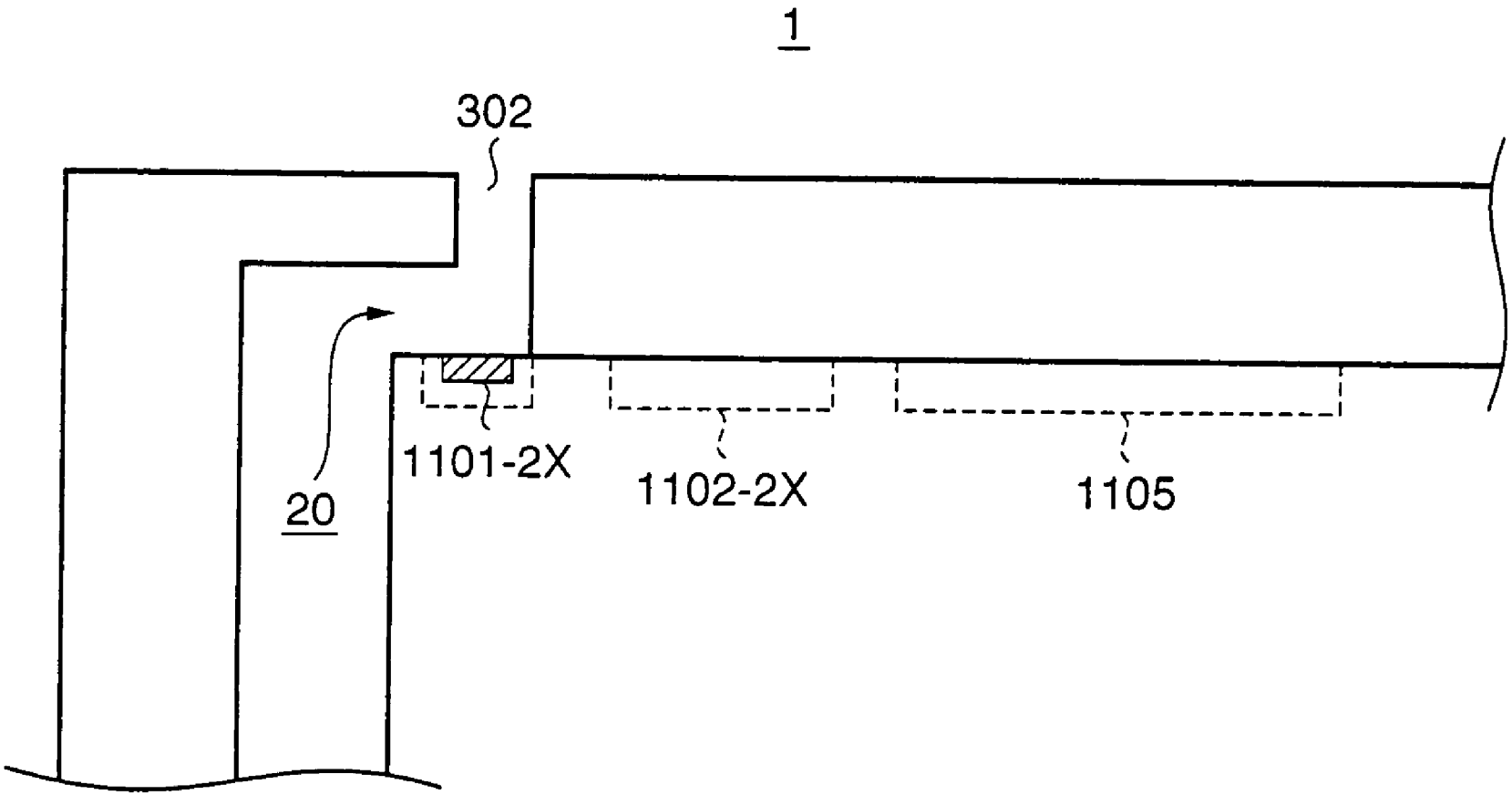
FIG. 9 is a part of a cross section of an inkjet printhead using the head substrate shown in FIG. 8.

FIG. 9 is a part of a cross section of an inkjet printhead using the head substrate shown in FIG. 8.

As shown in FIG. 9, the orifice 302 is provided in a position opposite to the heater 1101-2*x* in the head substrate 1. Ink supplied to the heater position through a ink supply channel 20 formed in an edge portion of the head substrate 1 is heated up and discharged from the orifice 302.

Figure 10:
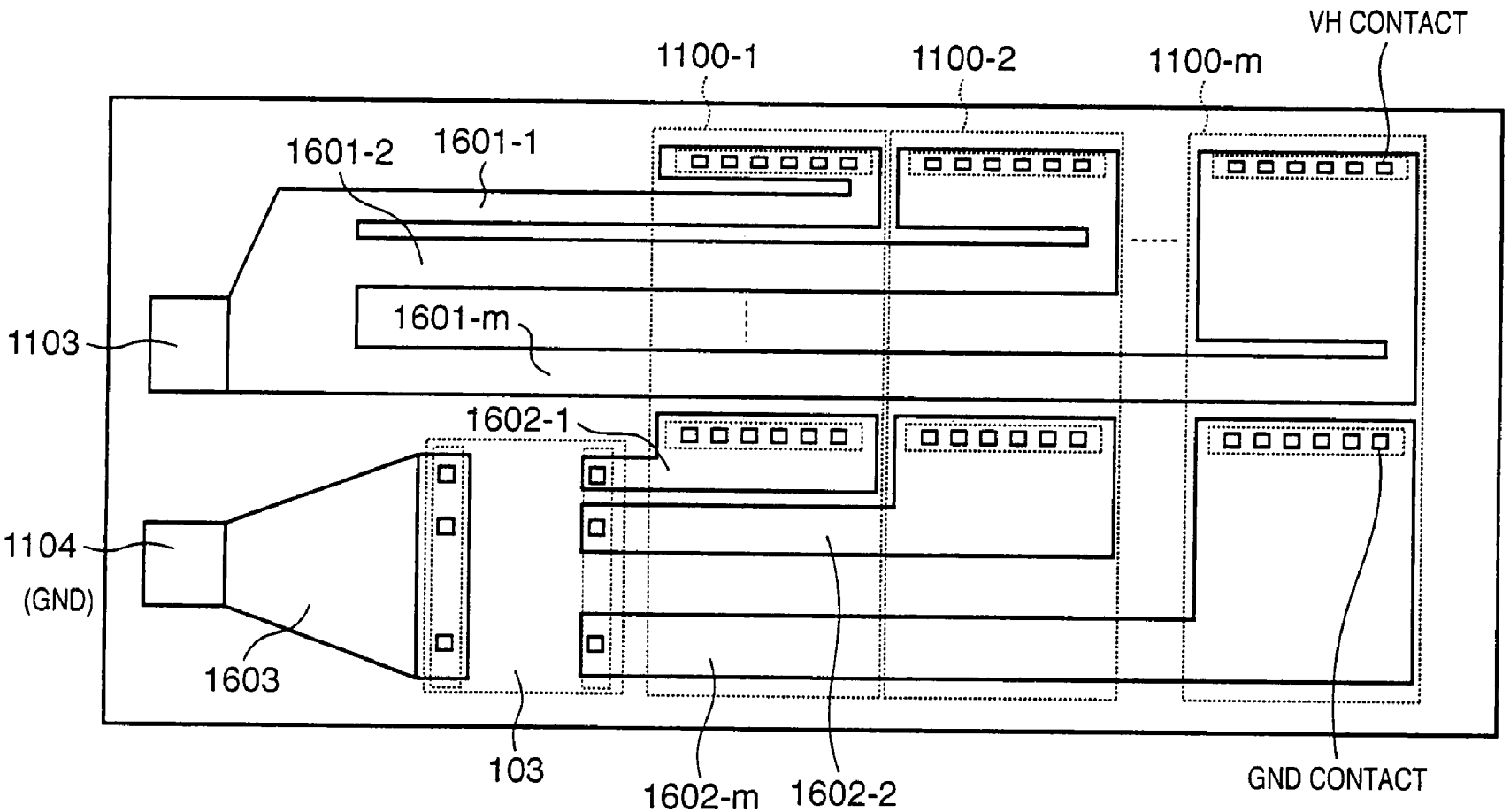
FIG. 10 is a view showing the layout of power supply lines on the head substrate shown in FIG. 8.

FIG. 10 is a view showing the layout of power supply lines portion on the head substrate shown in FIG. 8.

As is apparent from FIG. 10, power supply lines 1601-1 to 1601-*m* are connected to a power supply pad 1103, and connected via VH contacts to the heaters 1101-11 to 1101-*mx* of the groups 1100-1 to 1100-*m*. Power supply lines 1602-1 to 1602-*m* are connected to the output terminals of the constant electric current source group 103 and the source terminals of the MOS transistors 1102-11 to 1102-*mx* for the respective groups. The ground (GND) terminal of the constant electric current source group 103 is commonly connected to a GND pad 1104 via a power supply line 1603.

As is apparent from the layout shown in FIG. 8, the constant electric current sources 103-1 to 103-*m* are not disposed in the respective group areas 1100-1 to 1100-*m*, but are interposed, as the constant electric current source group 103 where a plurality of constant electric current sources are assembled, between the heater group, the transistor group, and the input/output pad group 1501.

In general, the head substrate is long in the heater array direction, i.e., long in the lateral direction in FIGS. 8 and 10 so that many heaters are arrayed in view of high speed printing, and short in a direction perpendicular to the heater array direction in order to reduce the area of the head substrate. If the head substrate becomes long in the direction perpendicular to the heater array owing to the elongated shape, the area of the head substrate greatly increases, and the number of head substrates produced from one piece of wafer decreases greatly.

To prevent this, according to the first embodiment, the number of types of elements and circuits disposed in an area parallel to the heater array (in a direction perpendicular to the heater array direction) is as few as possible. In an example of FIG. 8, only driving elements (MOS transistors) required to be equal in number to heaters, and a control circuit for controlling the driving elements are affanged, and other circuit elements (e.g., constant electric cuffent source group) and input/output pads are all arranged in an end portion of the head substrate which exists on the extension of the heater array. This layout suppresses an increase in the area of the head substrate.

More specifically, in the first embodiment, constant electric current sources formed from elements smaller in number than heaters are interposed between the input/output pad portion and the heater array portion, thereby suppressing an increase in substrate size caused by a circuit concerning driving of a constant electric current.

An arrangement of the constant electric current source group according to the present invention is not only for suppressing an increase in the head substrate size but also for the following reason.

The voltage drops in wirings from the constant electric current source group to heaters of each group do not differ from each other in that the number of concurrently drivable heaters in each group is just one. However, the amount of voltage drop in a wiring from the constant electric current source to the GND pad 1104 varies depending upon the number of concurrently driven heaters in that the electric currents from plural groups flow into the wiring. In this embodiment, as shown in FIG. 10, since the constant electric current sources from the respective groups are all disposed in an area near the input/output pads (an area between the heater group, the transistor group, and the input/output pads), a distance between the pads and the constant electric current source is short. This contributes to reducing the variation of the voltage drop amount occurring at a wiring to the constant electric current source.

Since lengths of wiring 1603 from the GND pad to a plurality of constant electric current sources are almost equal, as shown in FIG. 10, wiring resistances between the GND pad and the respective constant electric current sources substantially become equal. The source voltages of MOS transistors which form the respective constant electric current sources become equal, contributing to stable driving of MOS transistors at high reliability.

Furthermore, as shown in FIG. 10, regarding common wirings such as power supply lines 1601-1 to 1601-*m* and power supply lines 1602-1 to 1602-*m* which extend from the constant electric current source group 103 from which a predetermined current flow to the respective MOS transistors for switching, the longer the length of the wirings become, the wider the width of the wirings becomes. As a result, the wiring resistances over the groups are substantially equal to each other. Therefore, it is not necessary to adjust an applied voltage according to a higher wiring resistance. This contributes to reducing electric power loss.

Second Embodiment

Figure 11:
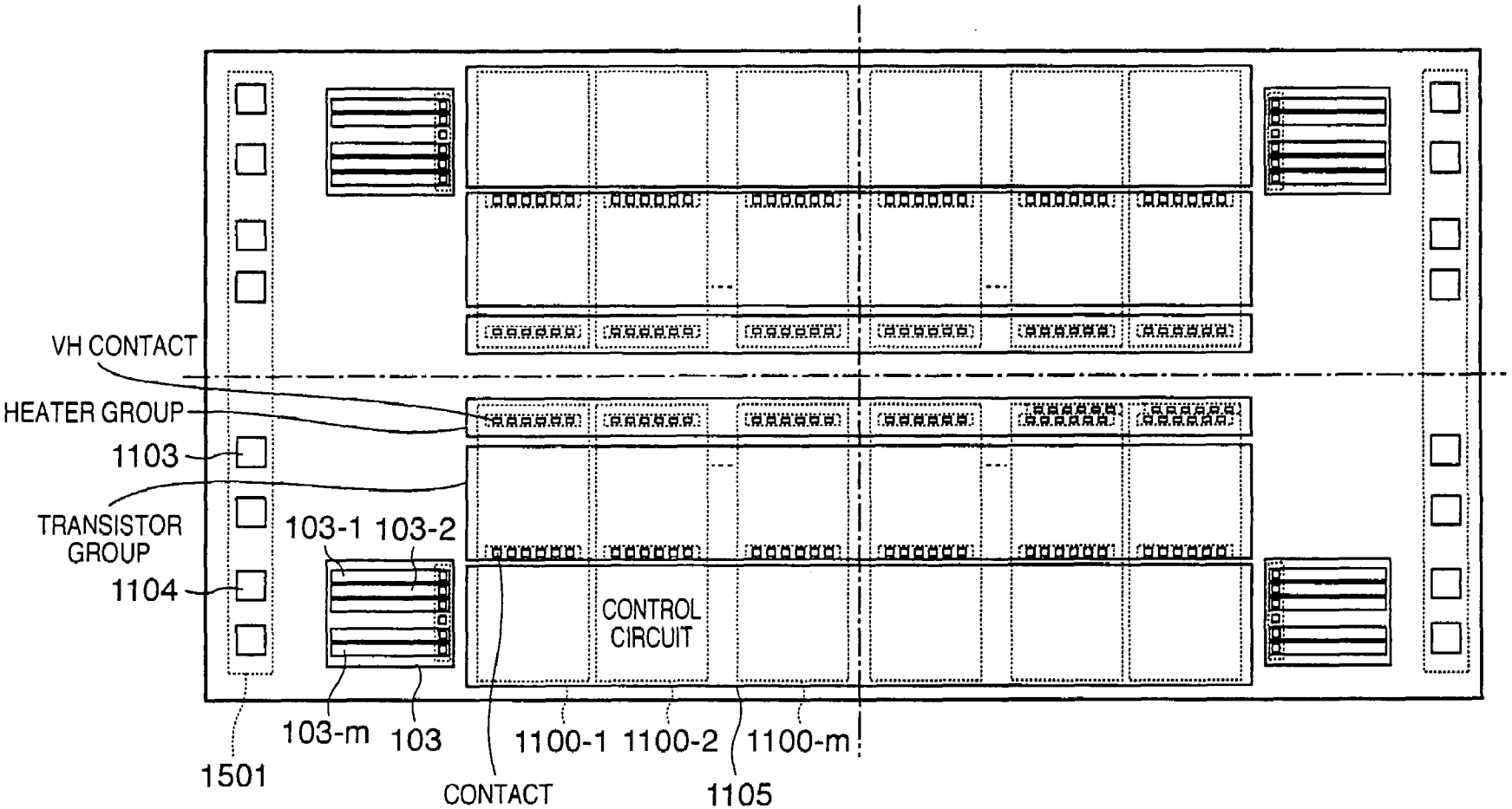
FIG. 11 is a view showing the layout of a head substrate according to a second embodiment of the present invention.

FIG. 11 is a view showing the layout of a head substrate according to the second embodiment of the present invention.

FIG. 11 illustrates an example of a layout which implements the heater driving circuit shown in FIG. 5. Chain lines shown in FIG. 11 represent symmetric axes. Also in FIG. 11, the same reference numerals as those in FIG. 5 denote the same building components.

Figure 12:
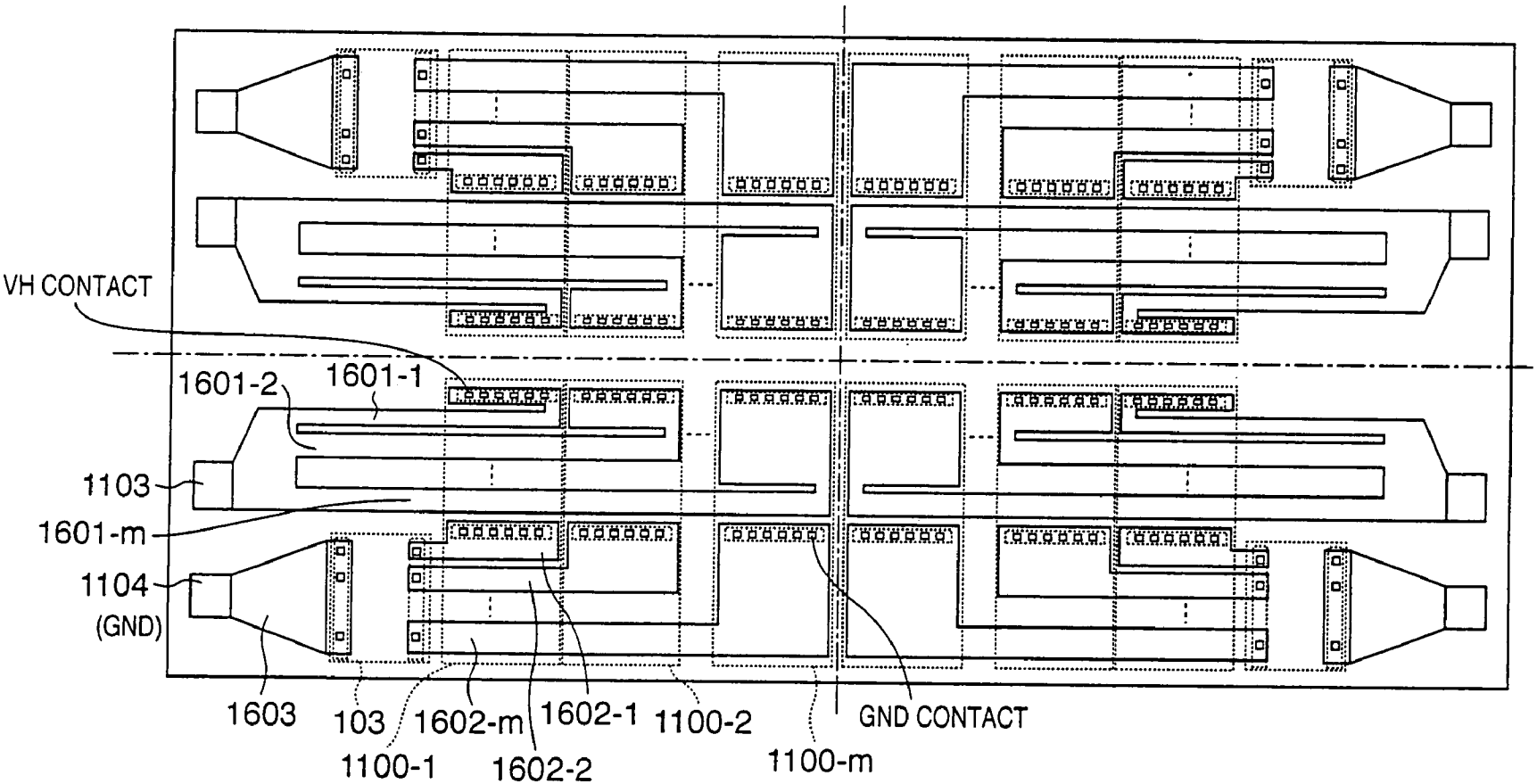
FIG. 12 is a view showing the layout of power supply lines on the head substrate shown in FIG. 10.

FIG. 12 is a view showing the layout of power supply lines on the head substrate shown in FIG. 11.

In the layout of the second embodiment, four heater driving circuits shown in FIG. 5 are symmetrically arranged on the same head substrate. The operation of each circuit is the same as that described in the first embodiment. Hence, reference numerals are given to only one of the four sections. In this arrangement, ink is supplied from a hole (ink channels 2C, 2M, 2Y) at the center of the substrate to heaters arranged on the upper surface of the head substrate, as shown in FIG. 3. By supplying an electric current to the heaters, ink can be discharged onto the upper surface of a paper sheet.

The arrangement shown in FIG. 11 can supply an electric current to the four heater driving circuits serving as constant electric current source groups. The printhead may be configured so that (x×m) heaters in each group are made to correspond to four nozzle arrays for discharging ink of the same color or four nozzle arrays for discharging inks of different colors.

In the arrangement according to the second embodiment, as shown in FIG. 12, the maximum lengths of power supply lines from pads arranged left and right (the shorter sides of the head substrate) are lengths to the center of the substrate, and a voltage drop by the power supply line can be efficiently suppressed.

Referring back to FIG. 11, the constant electric current source group is interposed on the head substrate between a corresponding heater array group and an adjacent pad group. Also in this case, an increase in the size of the head substrate by a circuit concerning driving of a constant electric current can be suppressed, similar to the first embodiment.

Third Embodiment

Figure 13:
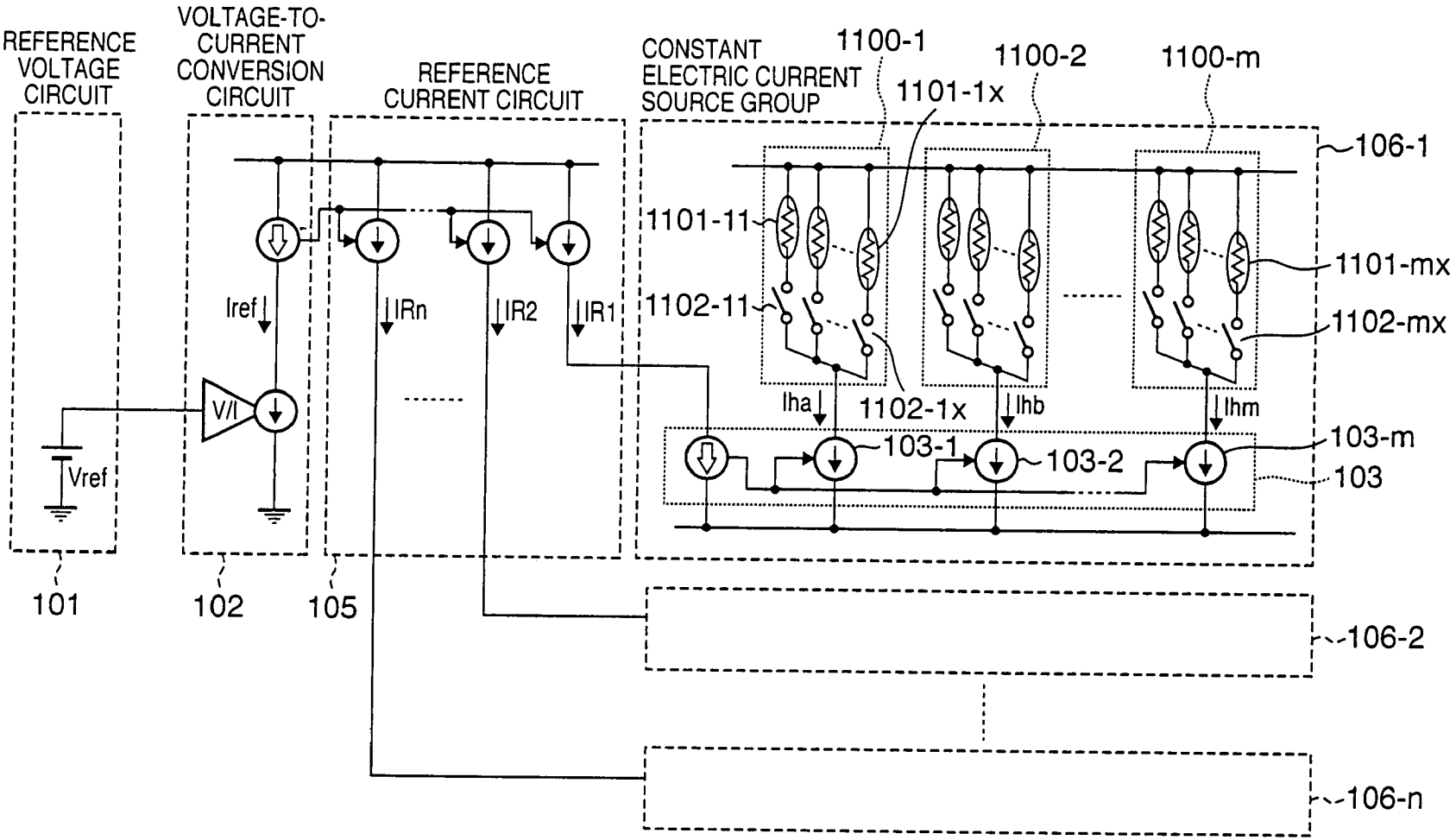
FIG. 13 is a circuit block diagram showing the arrangement of the head substrate, of a printhead IJH which adopts a constant electric current driving method, according to a third embodiment of the present invention.

FIG. 13 is a circuit block diagram showing the arrangement of the head substrate of a printhead IJH which adopts a constant electric current driving method according to the third embodiment. Also in FIG. 13, the same reference numerals as those described above denote the same building components. In FIG. 13, reference numerals 1102-11 to 1102-*mx* denote switches, and their entities are MOS transistors which function as switching elements, as described above.

The circuit arrangement is mainly comprised of a reference voltage circuit 101, a voltage-to-current conversion circuit 102, a reference current circuit 103, and n constant electric current source groups (heater driving circuits) 106-1 to 106-*n*.

The arrangement shown in FIG. 13 can supply an electric current to n constant electric current source groups (heater driving circuits). The (x×m) heaters in each group may be made to correspond to n nozzle arrays for discharging ink of the same color or n nozzle arrays for discharging inks of different colors.

The reference voltage circuit 101 generates a reference voltage (Vref) to be used by the voltage-to-current conversion circuit 102. The voltage-to-current conversion circuit 102 converts a voltage into an electric current on the basis of the reference voltage (Vref) to generate a reference current (Iref). The reference current circuit 105 generates a plurality of reference currents IR1 to IRn on the basis of the reference current (Iref) generated by the voltage-to-current conversion circuit 102. A plurality of reference currents IR1 to IRn proportional to the reference current (Iref) are generated from the reference current (Iref) by a current mirror circuit, and supplied to the n constant electric current source groups 106.

In the constant electric current source groups 106-1 to 106-*n*, constant electric currents Iha to Ihm proportional to the reference currents IR1 to IRn are output from the constant electric current sources 103-1 to 103-*m* of each constant electric current source group by using the reference currents IR1 to IRn as references. The operation of each constant electric current source is the same as that in the first embodiment, and a description thereof will be omitted.

Figure 14:
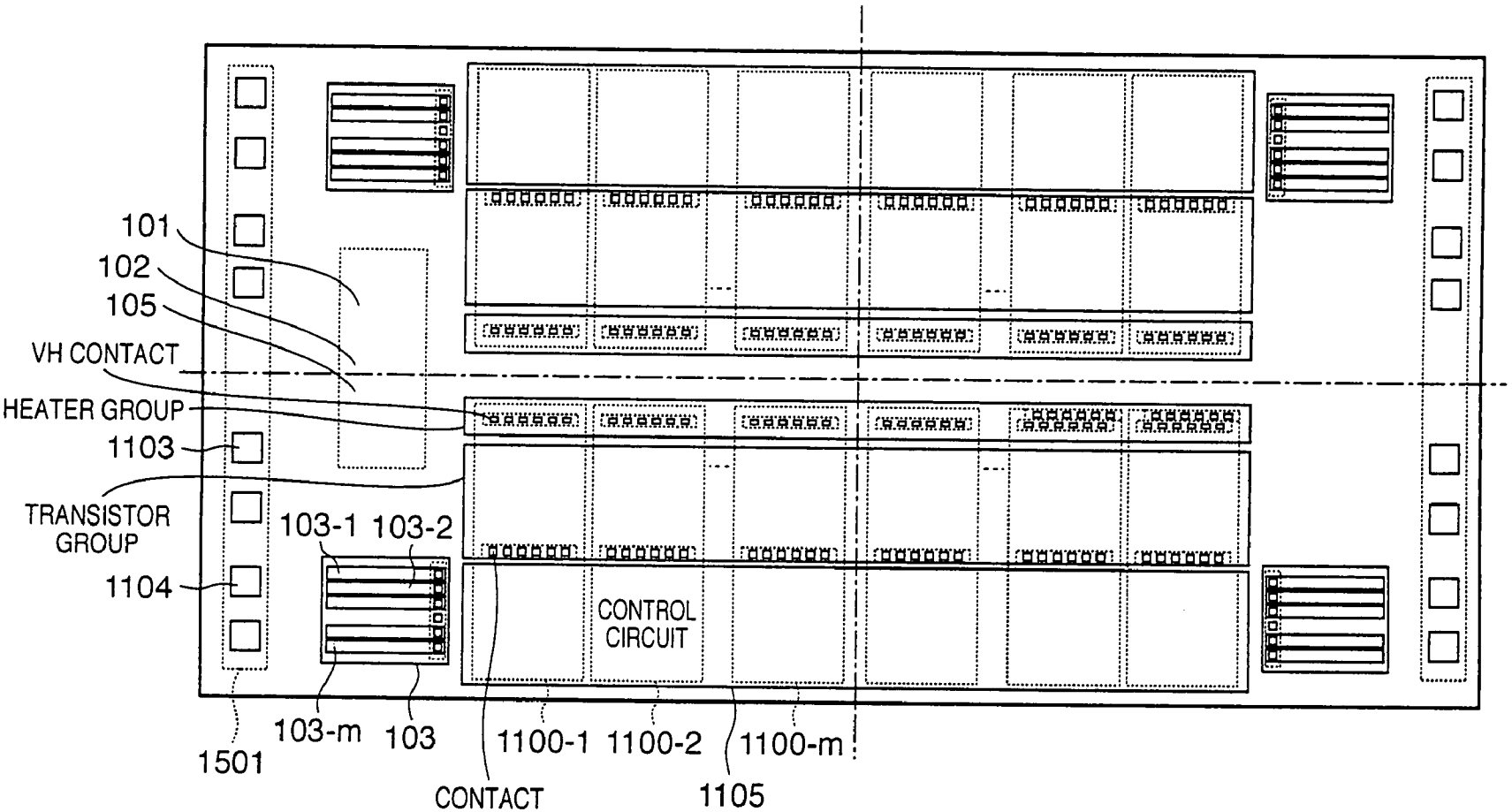
FIG. 14 is a view showing the layout of the head substrate according to the third embodiment of the present invention.

FIG. 14 is a view showing the layout of the head substrate according to the third embodiment.

FIG. 14 shows an example of a layout which implements the circuit of the head substrate shown in FIG. 13. Chain lines shown in FIG. 14 represent symmetric axes. Also in FIG. 14, the same reference numerals as those described above denote the same building components.

The third embodiment will exemplify a layout of four head driving circuits.

Also in the example shown in FIG. 14, similar to the second embodiment, each of the four constant electric current source groups is interposed between a heater array and an adjacent pad group. The reference voltage circuit, voltage-to-current conversion circuit, and reference current circuit are interposed together between the heater array and the pad group.

In the example shown in FIG. 14, the reference voltage circuit 101, voltage-to-current conversion circuit 102, and reference current circuit 105 are arranged at one portion (region surrounded by a broken line), but may be divided and arranged between a heater array and a pad group on an opposite (left and right) side of FIG. 14.

With this layout, the third embodiment can suppress an increase in the size of the head substrate caused by a circuit concerning driving of a constant electric current, similar to the first and second embodiments.

Fourth Embodiment

Figure 15:
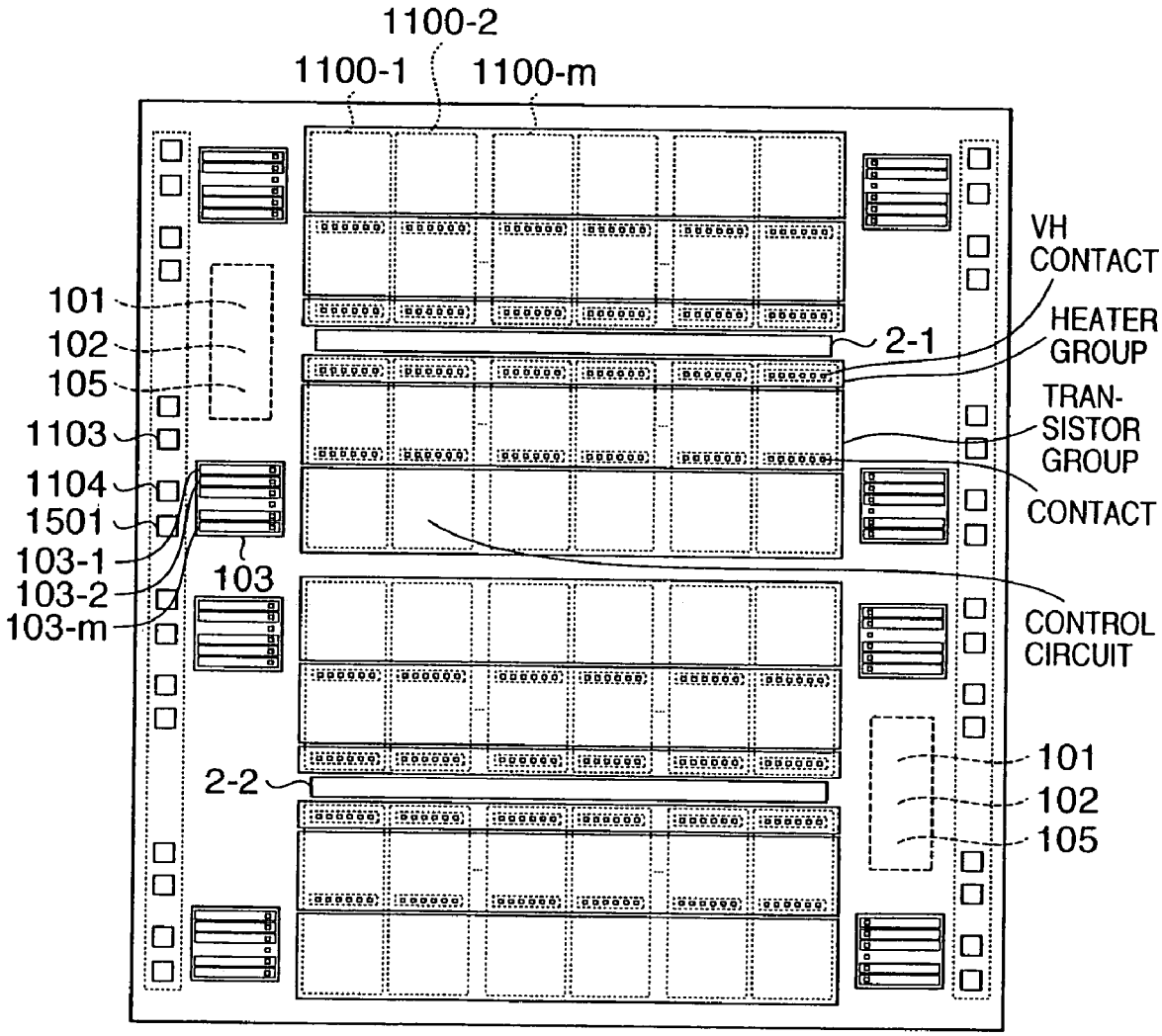
FIG. 15 is a view showing the layout of a single head substrate integrating two sets of circuit arrangement shown in FIG. 14.

FIG. 15 is a view showing the layout of a single head substrate integrating two sets of circuit arrangement shown in FIG. 14.

In this example, since two different electric currents supplied to the heaters can be set independent of each other, for example, the two types of heater arrays suitable to discharging two different amounts of ink can be configured in a single heat substrate.

Figure 16:
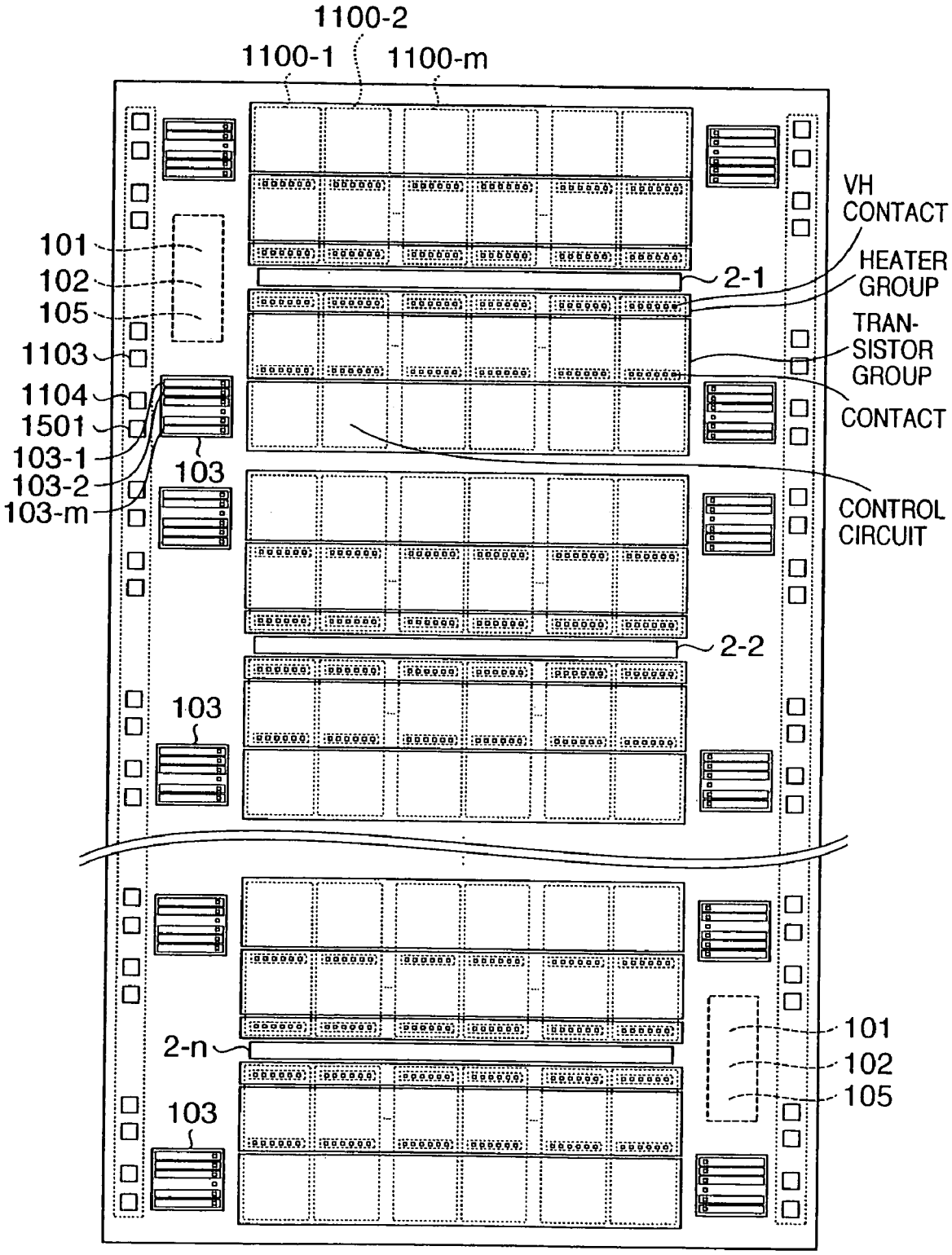
FIG. 16 is a view showing the layout of the head substrate suitable to color printing.

FIG. 16 is a view showing the layout where n heater arrays are arranged.

This arrangement is suitable to a case where plural color inks for color printing are discharged by heaters provided on a single head substrate.

Note that ink channels 2-1, 2-2, . . . , 2-*n* are illustrated in FIGS. 15 and 16. Since other building components are described before, the same reference numerals denote the same building components, and a description thereof will be omitted.

As many apparently widely different embodiments of the present invention can be made without departing from the spirit and scope thereof, it is to be understood that the invention is not limited to the specific embodiments thereof except as defined in the appended claims.

Claim of Priority

This application claims priority from Japanese Patent Aplication No. 2004-158029 filed on May 27, 2004, the entire contents of which are incorporated herein by reference.

What is claimed is:

1. A printhead substrate used for driving a plurality of printing elements provided on a rectangular board according to a driving method in which a constant electric current flows into the plurality of printing elements through a plurality of switching elements respectively corresponding to the plurality of printing elements, wherein the board has a longer side and shorter side, the plurality of printing elements and the plurality of switching elements for switching between driving the respective printing elements and not driving the respective printing elements are arrayed in a longer side direction of the board, a control circuit for controlling the plurality of switching elements is arranged along the longer side direction of the board, a terminal which receives a driving signal and a control signal that are supplied to the control circuit is arranged near the shorter side of the board, a constant electric current source, series-connected to the plurality of switching elements, for supplying the constant electric current to the plurality of printing elements is interposed in an area, in the longer side direction of the board, between a first area where the terminal is arranged and a second area where the plurality of printing elements, the plurality of switching elements and the control circuit are arrayed, and the plurality of printing elements, the plurality of switching elements and the control circuit are arranged in order in the shorter side direction of the board.

2. The printhead substrate according to claim 1, wherein a supply channel for supplying ink is provided in the longer side direction of the board.

3. The printhead substrate according to claim 1, wherein the plurality of printing elements are grouped into a plurality of groups, printing elements belonging to same groups are not concurrently driven, printing elements belonging to different groups are concurrently driven, a plurality of the electric current sources are provided in correspondence to the plurality of groups, and the plurality of the electric current sources are interposed together in the area between the first area and the second area.

4. The printhead substrate according to claim 1, further comprising:

a reference current circuit which generates a reference current used to generate a constant electric current by the electric current source;

a voltage-to-current conversion circuit which generates the reference current on the basis of a reference voltage; and a reference voltage circuit which generates the reference voltage, wherein said reference current circuit, said voltage-to-current conversion circuit, and said reference voltage circuit are interposed between the first area and the second area.

5. The printhead substrate according to claim 1, wherein a plurality of circuit element groups each obtained by interposing the electric current source between the first area and the second area are so arranged as to be at least one of vertically symmetrical and horizontally symmetrical on the board.

6. The printhead substrate according to claim 1, wherein the plurality of switching elements include MOS transistors.

7. A printhead using a printhead substrate according to claim 1.

8. The printhead substrate according to claim 3, wherein the constant electric current sources are composed of an MOS transistor operable in a saturated region.

9. The printhead substrate according to claim 3, wherein distances between the terminal and the plurality of constant electric current sources corresponding to the plurality of groups are substantially the same.

10. The printhead according to claim 7, wherein the printhead comprises an inkjet printhead which prints by discharging ink.

11. A head cartridge integrating an inkjet printhead according to claim 10 and an ink tank containing ink to be supplied to the inkjet printhead.

12. A printing apparatus for discharging ink onto a printing medium for printing by using an inkjet printhead according to claim 10 or a head cartridge according to claim 11.

* * * * *